United States Patent [19]

Sasaoka et al.

[11] Patent Number: 4,761,362

[45] Date of Patent: Aug. 2, 1988

[54] PROCESSING A PHOTOGRAPHIC MATERIAL COMPRISING AN EMULSION LAYER PROVIDING A CONTRAST GRADATION AND ANOTHER LAYER PROVIDING A SOFT TONE GRADATION

[75] Inventors: Senzo Sasaoka; Shigenori Moriuchi; Kimitaka Kameoka; Kazunobu Katoh; Yoshio Inagaki, all of Kanagawa, Japan

[73] Assignee: Fuji Photo Film Co., Ltd., Kanagawa, Japan

[21] Appl. No.: 947,301

[22] Filed: Dec. 29, 1986

[30] Foreign Application Priority Data

Dec. 25, 1985 [JP] Japan ..... 60-295468
Jul. 8, 1986 [JP] Japan ..... 61-160306

[51] Int. Cl.[4] ..... G03C 1/06

[52] U.S. Cl. ..... 430/267; 430/264; 430/265; 430/266; 430/446; 430/448; 430/444; 430/434; 430/502; 430/509; 430/949

[58] Field of Search ..... 430/264, 265, 266, 267, 430/446, 448, 444, 949, 434, 502, 509

[56] References Cited

U.S. PATENT DOCUMENTS 4,035,185 7/1977 Evans et al. ..... 430/230
4,332,885 6/1982 Ohmatsu ..... 430/217
4,681,836 7/1987 Inoue et al. ..... 430/264

FOREIGN PATENT DOCUMENTS 0004140 1/1981 Japan ..... 430/502
244872 10/1986 Japan .
1001001 8/1965 United Kingdom ..... 430/502

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

An image forming process capable of providing photographic images having extremely high contrast and high resolution for use in photoengraving is disclosed, which comprises processing an image-wise exposed silver halide light-sensitive material having at least two silver halide emulsion layers on a support, one of said emulsion layers providing a contrasty gradation and the other of said emulsion layers providing a soft tone gradation, with a hydrazine contrast development system, a tetrazolium contrast development system or a lith development system, wherein the gamma ($\gamma$) value of the portion having a density (D) from 0.3 to 1.5 on the characteristic curve obtained is less than 10 and the gamma ($\gamma$) value of the portion having a density (D) from 1.5 to 3.0 is at least 10.

11 Claims, No Drawings

PROCESSING A PHOTOGRAPHIC MATERIAL COMPRISING AN EMULSION LAYER PROVIDING A CONTRAST GRADATION AND ANOTHER LAYER PROVIDING A SOFT TONE GRADATION

FIELD OF THE INVENTION

This invention relates to a process of forming photographic images having extremely high contrast and high resolution for use in the field of photoengraving.

BACKGROUND OF THE INVENTION

It is known that photographic images having extremely high contrast can be formed by using a certain kind of silver halide.

For example, a lith development system, i.e., a process of obtaining extreme contrast images by processing a lith type silver halide photographic material containing silver chlorobromide with a hydroquinone developer (lith developer) having a very low (lower than about 0.1 mol/liter) sulfite concentration is well known.

Also, a process of obtaining extremely high contrast negative photographic images by processing a surface latent image type silver halide photographic material containing a hydrazine derivative (e.g., the specific acylhydrazine compounds as described in U.S. Pat. Nos. 4,166,742, 4,168,977, 4,221,857, 4,224,401, 4,243,739, 4,272,606, 4,311,781, etc.) with a solution having a high pH and containing a sulfurous acid preservative of at least 0.15 mol/liter (hereinafter, this process is referred to as a hydrazine contrast development system) is well known.

Furthermore, a process of obtaining extremely high contrast images by processing a photographic light-sensitive material containing a tetrazolium compound with a PQ type or MQ type developer containing a sulfite in a relatively high concentration together with a hydroquinone (Q) as a developing agent and an auxiliary developing agent such as a 1-phenyl-3-pyrazolidone (P) or a p-aminophenol (M) for obtaining super additivity is disclosed, for example, in Japanese Patent Application (OPI) Nos. 18317/77, 17719/78, and 17720/78 (hereinafter, this process is referred to as a tetrazolium contrast development system) (the term "OPI" as used herein means an "unexamined published patent application").

The lith development system, hydrazine contrast development system, and tetrazolium contrast development system described above all can give an extremely high contrast of a gamma ($\gamma$) value of over 10 but, on the other hand, since the slope of the characteristic curve at the toe is very steep, these systems have the disadvantage that when the exposure amount is reduced, the images of fine lines are difficult to obtain. For example, when a letter original is photographed using a process camera, in the case of an extreme contrast light-sensitive material showing a very steep slope at the toe portion of the characteristic curve, the letter density is suddenly reduced with under exposure to make the images unreadable as letters. Accordingly, these systems have the disadvantage of narrowing the latitude as to deviation in exposure amount for a light-sensitive material having such a high contrast.

This disadvantage can be eliminated by using a light-sensitive material having a relatively soft tone of less than 10 in $\gamma$ value. That is, when the exposure amount is reduced in the case of a soft tone light-sensitive material, the sudden reduction of the density of letter images does not occur and also when the exposure amount is reduced in this case, the letter images formed have a density which can be used in the subsequent reversing step and thus images which can be used as letters can be obtained.

As described above, a soft tone light-sensitive material has the advantage that the latitude in the low exposure side is broad but, on the contrary, has the disadvantage that a high background density (Dmax) is not obtained. That is, the density of the portion (solid black on a negative film) corresponding to the white portion of an original becomes higher as the $\gamma$ value at the high density area of 1.5 or more in density of the characteristic curve increases and a soft tone light-sensitive material has the disadvantage that Dmax is low since the $\gamma$ value at the high density side is low. An original for camera-ready art in line image photographing is composed of an original having a high letter density, an original having a low letter density and a low contrast, an original of Ming style type (narrow line width) or Gothic type (bold line width), an original having a colored base, etc., and the optimum exposure amount differs for each of these different kinds of originals.

In the case of photographing the original for camera-ready art composed of a combination of these originals each having a different optimum exposure amount, the selection of the exposure condition is very difficult for a light-sensitive material having a narrow exposure latitude. As a result, it is sometimes impossible to photograph the whole portions of the original for camera-ready art with good reproducibility by one photographing and also sometimes each portion of the original must be separately photographed different exposure condition for each.

In other words, when the exposure amount is reduced for reproducing black fine lines of an original, the background density (corresponding to the solid black portion on a negative film and shown by Dmax) is reduced and the density of white fine lines of the original (white lines in the black background) is low and collapsed. Also, when, on the contrary, the exposure amount is increased, black fine lines are collapsed in the images formed. Accordingly, a photographic light-sensitive material having a broad exposure latitude in such line image photographing and providing a high background density (Dmax) has been desired.

SUMMARY OF THE INVENTION

An object of this invention is, therefore, to provide a process for forming images having extremely high contrast and high resolution with a broad exposure latitude in line image photographing.

Another object of this invention is to provide a process for forming line images having a high background density (Dmax) and extremely high contrast with good reproducibility.

It has been discovered that the above-described objects are attained by an image forming process which comprises processing an image-wise exposed silver halide light-sensitive material having at least two silver halide emulsion layers on a support, one of said emulsion layers providing a contrasty gradation and the other of said emulsion layers providing a soft tone gradation, with a hydrazine contrast development system, a tetrazolium contrast development system or a lith development system, wherein the gamma ($\gamma$) value of the portion having a density (D) from 0.3 to 1.5 on the characteristic curve obtained is less than 10 and the gamma ($\gamma$) value of the portion having a density (D) from 1.5 to 3.0 is at least 10.

DETAILED DESCRIPTION OF THE INVENTION

The above-described $\gamma$ value at the portion of D of from 0.3 to 1.5 is hereinafter referred to as $\gamma_L$ value and the $\gamma$ value at the portion of D of from 1.5 to 3.0 is referred to as $\gamma_H$ value.

In this invention, $\gamma_H$ and $\gamma_L$ can be practically obtained by the following method. That is, the inclination of the straight line connecting the point of density=0.3 an the point of density=1.5 on the characteristic curve obtained by developing an exposed light-sensitive material as $\gamma_L$ and the inclination of the straight line connecting the point of density=1.5 and the point of density=3.0 is $\gamma_H$.

That is:

$$\gamma_L = \frac{1.5 - 0.3}{\log(a) - \log(b)}$$

$$\gamma_H = \frac{3.0 - 1.5}{\log(c) - \log(a)}$$

(a): Exposure amount at density=1.5
(b): Exposure amount at density=0.3
(c): Exposure amount at density=3.0

In this invention, the $\gamma_L$ value is less than 10, preferably from 2 to 9, more preferably from 4 to 8.

Also, the $\gamma_H$ value is at least 10, preferably at least 12, more preferably from 12 to 50.

The light-sensitive material for use in this invention may have at least two silver halide emulsion layers (more specifically, silver halide emulsion layers capable of substantially contributing to image formation) and may have three or four such emulsion layers.

When the light-sensitive material for use in this invention has two silver halide emulsion layers, it is preferred that one of these layers is an emulsion layer providing a contrasty gradation (contrast emulsion layer) an the other is an emulsion layer providing soft-tone gradation (soft tone emulsion layer).

In this case, the former mainly takes part in the gradation in the region of at least 1.5 in density and the latter in the region of less than 1.5 in density.

Also, it is preferred that the contrast emulsion layer has a $\gamma$ value of at least 10 and the soft tone emulsion layer has a $\gamma$ value of less than 10.

The contrast emulsion layer and the soft tone emulsion may be disposed on a support in any desired order.

In other words, the O layer (the emulsion layer disposed at the portion farther from the support) may be the contrast emulsion layer and the U layer (the emulsion layer disposed at the position nearer the support) may be the soft tone emulsion layer. Also, the O layer may have a higher sensitivity or the U layer may have a higher sensitivity.

Furthermore, the contrast emulsion layer may be constructed of two or more layers and also the soft tone layer may be constructed of two or more layers.

The sensitivity ($S_H$) of the contrast emulsion layer may be higher than the sensitivity ($S_S$) of the soft tone emulsion layer or $S_S$ may be higher than $S_H$ in this invention but it is preferred that they satisfy the following relation:

$$0 \leqq |S_H - S_S| \leqq 0.6$$

wherein, $S_H$ and $S_S$ each is the value obtained by applying sensitometry to each sample prepared by coating each emulsion on a support in single layer. More specifically, the value is shown by the logarithm (log E) of the exposure amount (E) giving the density of 1.5 of the characteristic curve obtained by exposing each emulsion layer through a sensitometric optical wedge to tungsten light and then subjecting the emulsion layer to a given development process.

The given development process is the processing condition of practically developing the light-sensitive material for use in this invention and when the contrast emulsion is a lith emulsion, a lith developer solution is used, when the contrast emulsion is an emulsion containing a tetrazolium compound, Developer (I) described in Example 1 below is used, and when the contrast emulsion is an emulsion containing a hydrazine derivative, the developer in Example 3 below is used.

Also, it is more preferred that these value satisfy the following relation:

$$0.1 \leqq |S_H - S_S| \leqq 0.5.$$

When $S_S - S_H$ is larger than 0.6, high Dmax is difficult to obtain and the sharpness of images formed is lowered.

Also, when $S_H - S_S$ is larger than 0.6, the reproducibility of fine lines is reduced and the exposure latitude is narrowed.

Also, when the O layer is the contrast emulsion layer and the U layer is the soft tone emulsion layer, it is preferred that the above-described sensitivity value satisfy the following relation:

$$0 < S_S - S_H \leqq 0.6$$

also it is more preferred that they satisfy the following relation:

$$0.1 \leqq S_S - S_H \leqq 0.5.$$

Then, when the O layer is the soft tone emulsion layer and the U layer is the contrast emulsion layer, it is preferred that the sensitivity values satisfy the following relation:

$$-0.6 \leqq S_S - S_H \leqq 0$$

also it is more preferred that they satisfy the following relation:

$$-0.5 \leqq S_S - S_H \leqq -0.1$$

As described above, $S_H$ and $S_S$ may satisfy the above described relation and the sensitivity value of the silver halide emulsion layer practically used depends upon the halogen composition, grain sizes, gradation, etc., of the silver halide emulsion for use.

The coating amount of silver (silver coverage) of the light-sensitive material for use in this invention is preferably from 2.5 to 6.0 g/m$^2$, more preferably from 3.0 to 5.0 g/m$^2$.

There is no particular restriction on the ratio of the coating amounts of silver in the silver halide emulsion layers. However, when the light-sensitive material has two emulsion layers, the coating silver ratio (by mol) of O layer/U layer is preferably from 2/8 to 8/2, more preferably from 3/7 to 7/3.

The total thickness of the silver halide emulsion layers is preferably from 1.5 to 5.0 μm, more preferably from 2.0 to 4.0 μm.

The above-described characteristic curve in this invention can be obtained by developing a silver halide photographic material having at least one emulsion layer providing a contrasty gradation and at least one emulsion layer providing a soft-tone gradation.

In this invention, for the emulsion layer providing a contrasty gradation, a silver halide emulsion providing a contrasty gradation after development can be used. Practically, the emulsions which are used for the above-described hydrazine contrast development system, tetrazolium contrast development system, and lith development system can be used.

Also, for the emulsion layer providing a soft tone gradation, a silver halide emulsion providing a soft tone gradation after development can be used. When an ordinary silver halide emulsion, i.e., an emulsion other than those in the above-described three development systems is used, a soft tone gradation ($\gamma<10$) is obtained. That is, by using a silver halide emulsion which is used for general light-sensitive materials such as photographing light-sensitive materials (e.g., negative photographic films, reversal photographic films, etc.), photographic papers, X ray films, etc., a soft tone gradation can be obtained.

Typical methods of obtaining the characteristic curve as in this invention are as follows.

Method (1): A method of processing a light-sensitive material having a contrast emulsion layer using an emulsion containing a sufficient amount of a hydrazine derivative for increasing the contrast thereof and a soft tone emulsion layer containing no hydrazine derivative or containing a hydrazine derivative to an extent which does not increase the contrast thereof with a MQ developer or PQ developer.

The PQ developer or MQ developer is a developer with super additivity and containing an auxiliary developing agent such as a 1-phenyl-3-pyrazolidone (P) or a p-aminophenol (M) in addition to a hydroquinone (Q) as a developing agent as described hereinbefore. Such a developer has excellent storability as compared with a developer containing hydroquinone alone (e.g., lith developer). In this case, the amount of a hydrazine derivative to the extent of not increasing the contrast is preferably less than $\frac{1}{2}$, more preferably less than $\frac{1}{4}$, (by mol ratio) of the amount sufficient for increasing the contrast.

Method (2): A method of processing a light-sensitive material having a contrast emulsion layer using an emulsion containing a tetrazolium compound and a soft tone emulsion layer using an emulsion which does not contain a sufficient amount of a tetrazolium compound for increasing the contrast or containing a hydrazine derivative to an extent which does not increase the contrast with a MQ developer or PQ developer.

Now, the amount of a tetrazolium compound to the extent of not increasing the contrast is preferably less than $\frac{1}{2}$, more preferably less than $\frac{1}{4}$, (by mol ratio) of the sufficient amount thereof for increasing the contrast.

Method (3): A method of processing a light-sensitive material having a contrast emulsion layer using a lith emulsion containing a sufficient amount of a polyalkylene oxide compound for increasing the contrast and a soft tone emulsion layer using an emulsion which does not contain any polyalkylene oxide compound or which contains a polyalkylene oxide to an extent which does not increase the contrast with a lith developer.

The amount of a polyalkylene oxide compound to the extent of not increasing the contrast is preferably less than $\frac{1}{2}$, more preferably less than $\frac{1}{4}$, (by mol ratio) of a sufficient amount thereof for increasing the contrast.

In Methods (1) to (3) described above, for the soft tone emulsion layer, any one of the emulsions capable of giving a $\gamma$ value of less than 10 by processing with a lith developer, PQ developer, or MQ developer can be used.

Method (1) is explained in detail.

Examples of the hydrazine derivative which can be used in Method (1) are arylhydrazines wherein a sulfinic acid residue is bonded to the hydrazo moiety as described in U.S. Pat. No. 4,478,928 which is herein incorporated by reference and compounds represented by general formula (I).

$$R_1—NHNH—G_1—R_2 \quad (I)$$

wherein, $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and $G_1$ represents a carbonyl group, a sulfonyl group, a sulfinyl group, an N-substituted or unsubstituted iminomethylene group, or a mono-substituted phosphoryl group represented by

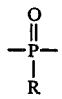

wherein R represents a substituted or unsubstituted alkoxy group, a substituted or unsubstituted alkyl group or a substituted or unsubstituted phenyl group.

The aliphatic group shown by $R_1$ in general formula (I) described above has preferably 1 to 30 carbon atoms and is particularly a straight chain, branched, or cyclic alkyl group having 1 to 20 carbon atoms. In this case, the branched alkyl group may be cyclized to form a saturated heterocyclic ring containing one or more hetero atoms therein. Also, the alkyl group may contain a substituent such as an aryl group, an alkoxy group, a sulfinyl group, a sulfonamido group, a carbonamido group, etc.

The aromatic group shown by $R_1$ in general formula (I) is a monocyclic or bicyclic aryl group or an unsaturated heterocyclic group. The unsaturated heterocyclic group may form a heteroaryl group by the condensation with a monocyclic or bicyclic aryl group.

Examples of aromatic groups are those containing a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc., and in these groups, the groups containing a benzene ring are preferred.

The particularly preferred group shown by $R_1$ is an aryl group.

The aryl group or the unsaturated heterocyclic group shown by $R_1$ may be substituted. Specific examples of substituents are a straight chain, branched, or cyclic alkyl group (preferably having 1 to 20 carbon atoms), an aralkyl group (preferably having a monocyclic or bicyclic aryl moiety and the alkyl moiety of 1 to 3 carbon atoms), an alkoxy group (preferably having 1 to 20 carbon atoms), a substituted amino group (preferably, an amino group substituted by an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), etc.

The alkyl group shown by $R_2$ in general formula (I) is preferably an alkyl group having 1 to 4 carbon atoms and the alkyl group may have a substituent such as a halogen atom, a cyano group, a carboxy group, a sulfo group, an alkoxy group, a phenyl group, etc.

The aryl group shown by $R_2$ in general formula (I), which may be substituted, is a monocyclic or bicyclic aryl group containing, e.g., a benzene ring. The aryl group may have a substituent such as a halogen atom, an alkyl group, a cyano group, a carboxy group, a sulfo group, etc.

The alkoxy group shown by $R_2$ in general formula (I), which may be substituted, is an alkoxy group having 1 to 8 carbon atoms and may have a substituent such as a halogen atom, an aryl group, etc.

The aryloxy group shown by $R_2$ in general formula (I), which may be substituted, is preferably a monocyclic group and may have a halogen atom, etc., as a substituent.

When $G_1$ is a carbonyl group, $R_2$ is preferably a hydrogen atom, a methyl group, a methoxy group, an ethoxy group, or a substituted or unsubstituted phenyl group and is particularly preferably a hydrogen atom.

When $G_1$ is a sulfonyl group, $R_2$ is preferably a methyl group, an ethyl group, a phenyl group, or a 4-methylphenyl group and is particularly preferably a methyl group.

When $G_1$ is a mono-substituted phosphoryl group, $R_2$ is preferably a methoxy group, an ethoxy group, a butoxy group, a phenoxy group, or a phenyl group and is particularly preferably a phenoxy group.

When $G_1$ is a sulfinyl group, $R_2$ is preferably a cyanobenzyl group, a methylthiobenzyl group, etc.

When $G_1$ is an N-substituted or unsubstituted iminomethylene group, $R_2$ is preferably a methyl group, an ethyl group or a substituted or unsubstituted phenyl group.

$R_1$ or $R_2$ in general formula (I) described above may contain therein a ballast group which is conventionally used as an additive for immobilization, such as of a coupler, etc. A ballast group is a group having at least 8 carbon atoms and relatively inert photographic property and can be selected from, for example, alkyl groups, alkoxy groups, phenyl groups, alkylphenyl groups, phenoxy groups, alkylphenoxy groups, etc.

$R_1$ or $R_2$ in general formula (I) may include therein a group increasing adsorption on the surface of silver halide grains. As such an adsorptive group, there are a thiourea group, a heterocyclic thiamido group, a mercapto heterocyclic group, a triazole group, etc., described in U.S. Pat. Nos. 4,385,108 and 4,459,347.

$G_1$ in general formula () is most preferably a carbonyl group.

Specific examples of compounds shown by general formula (I) are illustrated below but the invention is not to be construed as being limited to these compounds.

I-1

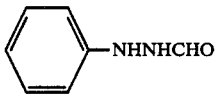

I-2

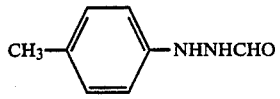

I-3

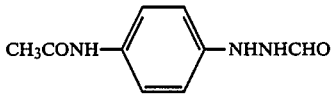

I-4

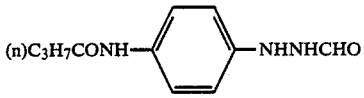

I-5

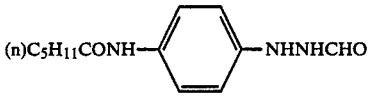

I-6

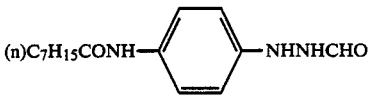

I-7

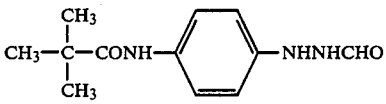

I-8

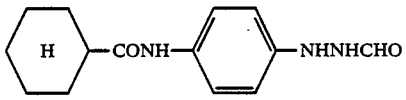

I-9

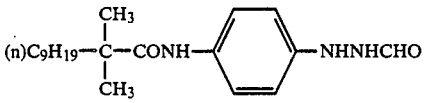

I-10

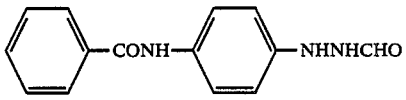

I-11

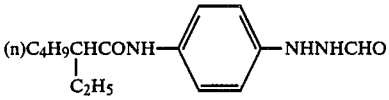

I-12

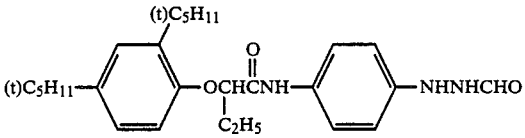

-continued
I-13
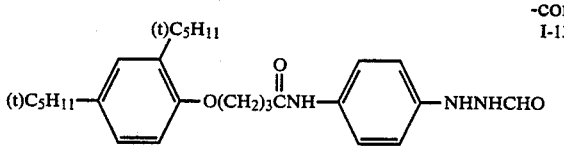
I-14
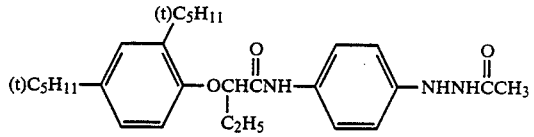
I-15
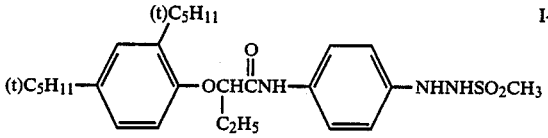
I-16
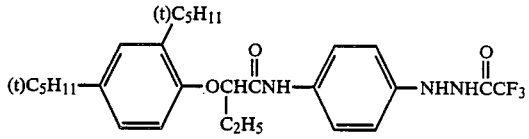
I-17
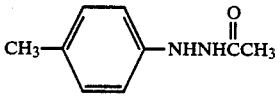
I-18
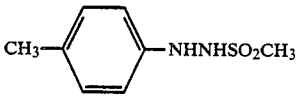
I-19
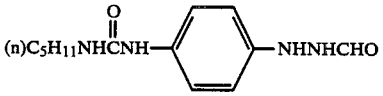
I-20
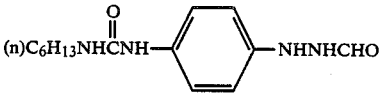
I-21
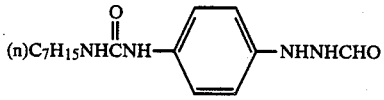
I-22
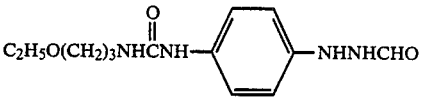
I-23
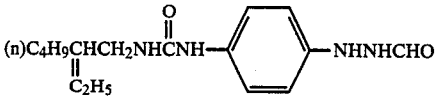
I-24
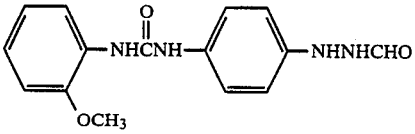
I-25
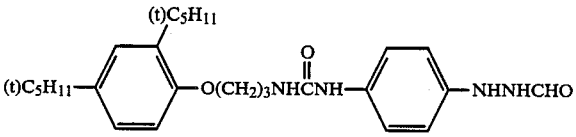
I-26
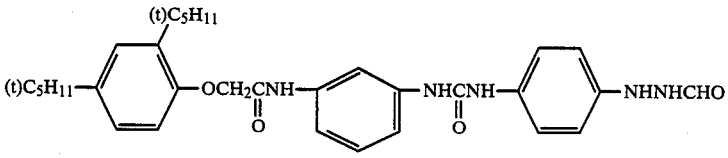
I-27
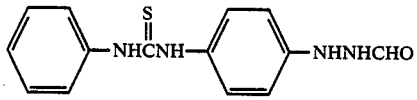
I-28
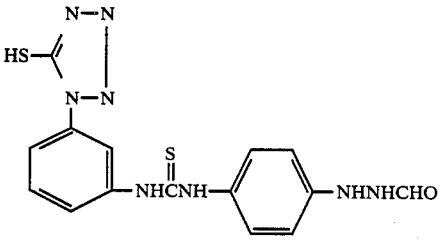
I-29
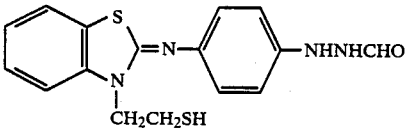
I-30
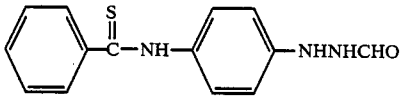
I-31
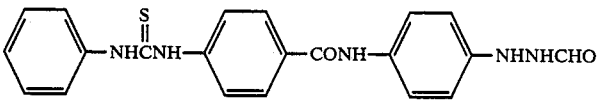

-continued

I-32

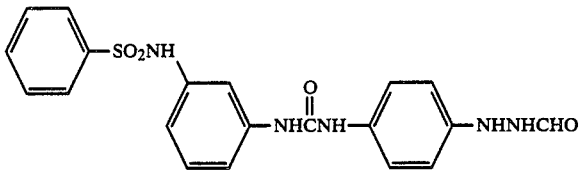

In this invention, it is preferred that the hydrazine derivative is incorporated in a silver halide emulsion in an amount of preferably from $1\times10^{-6}$ mol to $5\times10^{-2}$ mol, particularly from $1\times10^{-5}$ mol to $2\times10^{-2}$ mol, per mol of silver halide.

For incorporating the hydrazine derivative in a photographic light-sensitive material in this invention, the hydrazine derivative may be added to a silver halide emulsion as an aqueous solution when it is water soluble or as a solution in an organic solvent compatible with water, such as an alcohol (e.g., methanol, ethanol, etc.), an ester (e.g., ethyl acetate, etc.), a ketone (e.g., acetone, etc.), etc., when it is insoluble in water.

In this invention, the hydrazine derivatives may be used alone or as a mixture of two or more thereof.

Examples of tetrazolium compounds which can be used in Method (2) described above are the compounds described in U.S. Pat. No. 4,175,966, Japanese Patent Application (OPI) Nos. 17,719/78, 17,720/78, etc., and typical examples thereof are the compounds shown by following general formulae (IIa), (IIb), and (IIc):

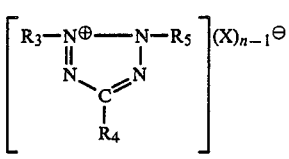

(IIa)

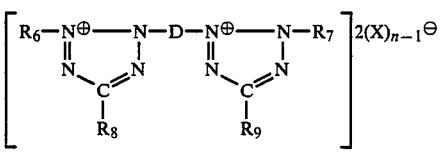

(IIb)

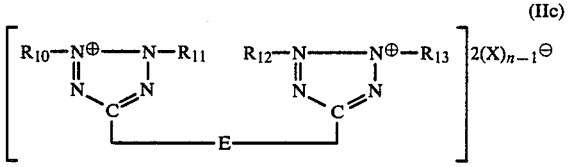

(IIc)

In the above formulae, $R_3$, $R_5$, $R_6$, $R_7$, $R_{10}$, $R_{11}$, $R_{12}$, and $R_{13}$ each represents an allyl group, a phenyl group (e.g., a phenyl group, a tolyl group, a hydroxyphenyl group, a carboxyphenyl group, an aminophenyl group, a mercaptophenyl group, etc.), a naphthyl group (e.g., an α-naphthyl group, a β-naphthyl group, a hydroxynaphthyl group, a carboxynaphthyl group, an aminonaphthyl group, etc.), or a heterocyclic group (e.g., a thiazolyl group, a benzothiazolyl group, an oxazolyl group, a pyrimidinyl group, a pyridyl group, etc.), which may form a metal chelate or complex; $R_4$, $R_8$, and $R_9$ each represents an allyl group, a phenyl group (e.g., a phenyl group, a tolyl group, a hydroxyphenyl group, a carboxyphenyl group, an aminophenyl group, a mercaptophenyl group, etc.), a naphthyl group (e.g., an α-naphthyl group, a β-naphthyl group, a hydroxynaphthyl group, a carboxynaphthyl group, an aminonaphthyl group, etc.), a heterocyclic group, an alkyl group (e.g., a methyl group, an ethyl group, a propyl group, a butyl group, a mercaptomethyl group, a mercaptoethyl group, etc.), a hydroxy group, a carboxy group or a salt thereof, an alkoxycarbonyl group (e.g., a methoxycarbonyl group, an ethoxycarbonyl group, etc.), an amino group (e.g., an amino group, an ethylamino group, an anilino group, etc.), a mercapto group, a nitro group, a cyano group, or a hydrogen atom; D represents a divalent aromatic group; E represents an alkylene group, an allylene group, or an aralkylene group (e.g.,

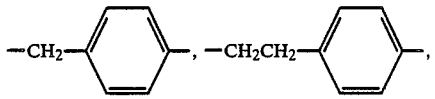

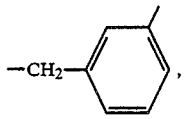

etc.); X represents an anion-forming atom or atomic group (e.g., a chlorine atom, a bromine atom, a perchloric acid, a sulfonic acid, a nitric acid, p-toluenesulfonic acid, etc.); and n represents 1 or 2. When the compound forms an intramolecular salt, n is 1.

Specific examples of the tetrazolium compound for use in this invention are shown below but the invention is not to be construed as being limited to these compounds.

II-1: 2-(benzothiazol-2-yl)-3-phenyl-5-dodecyl-2H-tetrazolium bromide
II-2: 2,3-Diphenyl-5-(4-t-octyloxyphenyl)-2H-tetrazolium chloride
II-3: 2,3,5-Triphenyl-2H-tetrazolium
II-4: 2,3,5-Tri(p-carboxyethylphenyl)-2H-tetrazolium
II-5: 2-(Benzothiazol-2-yl)-3-phenyl-5-(o-chlorophenyl)-2H-tetrazolium
II-6: 2,3-Diphenyl-2H-tetrazolium
II-7: 2,3-Diphenyl-5-methyl-2H-tetrazolium
II-8: 3-(p-Hydroxyphenyl)-5-methyl-2-phenyl-2H-tetrazolium
II-9: 2,3-Diphenyl-5-ethyl-2H-tetrazolium
II-10: 2,3-Diphenyl-5-n-hexyl-2H-tetrazolium
II-11: 5-Cyano-2,3-diphenyl-2H-tetrazolium
II-12: 2-(Benzothiazol-2-yl)-5-phenyl-3-(4-tolyl)-2H-tetrazolium
II-13: 2-(Benzothiazol-2-yl)-5-(4-chlorophenyl)-3-(4-nitrophenyl)-2H-tetrazolium
II-14: 5-Ethoxycarbonyl-2,3-di(3-nitrophenyl)-2H-tetrazolium
II-15: 5-Acetyl-2,3-di(p-ethoxyphenyl)-2H-tetrazolium
II-16: 2,5-Diphenyl-3-(p-tolyl)-2H-tetrazolium
II-17: 2,5-Diphenyl-3-(p-iodophenyl)-2H-tetrazolium II-18: 2,3-Diphenyl-5-(p-diphenyl)-2H-tetrazolium
II-19: 5-(p-Bromophenyl)-2-phenyl-3-(2,4,6-trichlorophenyl)-2H-tetrazolium
II-20: 3-(p-Hydroxyphenyl)-5-(p-nitrophenyl)-2-phenyl-2H-tetrazolium
II-21: 5-(3,4-Dimethoxyphenyl)-3-(2-ethoxyphenyl)-2-(4-methoxyphenyl)-2H-tetrazolium
II-22: 5-(4-Cyanophenyl)-2,3-diphenyl-2H-tetrazolium
II-23: 3-(p-Acetamidophenyl)2,5-diphenyl-2H-tetrazolium
II-24: 5-Acetyl-2,3-diphenyl-2H-tetrazolium
II-25: 5-(Furu-2-yl)-2,3-diphenyl-2H-tetrazolium
II-26: 5-(Thien-2-yl)-2,3-diphenyl-2H-tetrazolium
II-27: 2,3-Diphenyl-5-(pyrido-4-yl)-2H-tetrazolium
II-28: 2,3-Diphenyl-5-(quinol-2-yl)-2H-tetrazolium
II-29: 2,3,-Diphenyl-5-(benzoxazol-2-yl)-2H-tetrazolium
II-30: 2,3-Diphenyl-5-nitro-2H-tetrazolium
II-31: 2,2',3,3'-Tetraphenyl-5,5'-1,4-butylene-di-(2H-tetrazolium)
II-32: 2,2',3,3'-Tetraphenyl-5,5'-p-phenylene-di-(2H-tetrazolium)
II-33: 2-(4,5-Dimethylthiazol-2-yl)-3,5-diphenyl-2H-tetrazolium
II-34: 3,5-Diphenyl-2-(triazin-2-yl)-2H-tetrazolium
II-35: 2-(Benzothiazol-5-yl)-3-(4-methoxyphenyl)-5-phenyl-2H-tetrazolium When the tetrazolium compound is to be used as a non-diffusible compound, a non-diffusible tetrazolium compound obtained by reacting the diffusible compound in the above-described compounds and an anion is used.

Suitable anions which can be used in this case, include higher alkylbenzenesulfonic acid anions such as p-dodecylbenzenesulfonic acid anion, etc., higher alkylsulfuric acid ester anions such as lauryl sulfonate anion, etc., dialkyl sulfosuccinate anions such as di-2-ethylhexyl sulfosuccinate anion, etc., polyether alcohol sulfuric acid ester anions such as cetyl polyethenoxy sulfate anion, etc., higher fatty acid anions such as stearic acid anion, etc., acid radical-having polymers such as polyacrylic acid anion, etc.

By suitably selecting the anion moiety and the cation moiety, the non-diffusible tetrazolium compound for use in this invention can be synthesized.

In using the non-diffusible tetrazolium compounds, each of the anion moiety and the cation moiety as soluble salts is each dispersed in a gelatin solution and after mixing both dispersions, the mixture is dispersed in a gelatin matrix; or the crystal of the non-diffusible tetrazolium compound is previously synthesized, the crystal is dissolved in a suitable solvent (e.g., dimethylsulfoxide) and then the product is dispersed in a gelatin matrix. For uniformly dispersing, a proper homogenizer such as ultrasonic homogenizer or Manton-Gaulin homogenizer may be used.

As described above, as the tetrazolium compound for use in this invention, both a diffusible tetrazolium compound and a non-diffusible tetrazolium compound can be used, but images of higher contrast are obtained when a non-diffusible tetrazolium compound is used. Accordingly, when particularly excellent dot performance is required, it is relatively advantageous to use a non-diffusible tetrazolium compound.

The tetrazolium compounds for use in this invention may be used alone or as a mixture thereof.

It is preferred that the tetrazolium compound be used in the range of from $1\times10^{-3}$ to $5\times10^{-2}$ mol per mol of silver halide.

Silver halide emulsions which are used for the contrast emulsion layer and the soft tone emulsion layer for use in Method (1) and (2) described above are explained below.

There is no particular restriction as to the silver halide in the silver halide photographic emulsions and silver chloride, silver chlorobromide, silver iodobromide, etc., can be used.

The silver halide emulsion may be or may not be chemically sensitized. Suitable methods of chemical sensitization include conventional methods such as a sulfur sensitization method, a reduction sensitization method, and a noble metal sensitization method and they may be used individually or as a combination thereof.

A preferred chemical sensitization method is a sulfur sensitization method and, as the sulfur sensitizers, sulfur compounds contained in gelatin as well as other various sulfur compounds such as thiosulfates, thioureas, rhodanines, etc., can be used. Specific examples of suitable sulfur sensitizers are described in U.S. Pat. Nos. 1,574,944, 2,278,947, 2,410,689, 2,728,668, 3,501,313, 3,656,952, etc.

A typical noble metal sensitization method is a gold sensitization method and as a gold compound, gold complex salts are mainly used. In the noble metal sensitization method, other noble metals than gold may be also used and examples include complex salts of platinum, palladium, rhodium, etc. Specific examples thereof are described in U.S. Pat. No. 2,448,060, British Pat. No. 618,061, etc.

For the reduction sensitization method, stannous salts, amines, formamidinesulfinic acids, silane compounds, etc., can be used as the reduction sensitizers. Specific examples thereof are described in U.S. Pat. Nos. 2,487,850, 2,518,698, 2,983,609, 2,983,610, 2,694,637, etc.

The mean grain size of silver halide grains is preferably less than 0.7 μm, particularly preferably from 0.5 μm to 0.1 μm. The term "mean grain size" of silver halide is conventionally used in the silver halide photographic field and the term is well known and easily understood. The grain size means the diameter of the grain when the grain is a sphere or a grain closely resembling a sphere. When the grain is a cube, the grain size means the length shown by the equation, [length of the side]$\times\sqrt{4/\pi}$. The mean grain size is obtained by the algebric mean value or geometrical mean value based on the mean grain projected area. Detailed methods of obtaining mean grain sizes are described in C. E. Mees & T. H. James, *The Theory of the Photographic Process*, 3rd Ed., pp 36–43 by Macmillan Co. (1966).

There is no particular restriction on the form of silver halide grains and the grains may have a tabular form, a spherical form, a cubic form, a tetradecahedral form, a regular octahedral form, etc. Also, it is preferred that the distribution of the grain size be narrow. In particular, a so-called mono-dispersed silver halide emulsion wherein about 90%, preferably about 95%, of the total silver halide grains are in the grain size range of ±40% of the mean grain size is preferred.

During the formation of or during the physical ripening of the silver halide grains, a cadmium salt, a sulfite, a lead salt, a thallium salt, a rhodium salt or a complex salt thereof, an iridium salt or a complex salt thereof, etc., may present in the system.

For example, by using an iridium salt or a complex salt thereof in an amount of preferably $10^{-8}$ to $10^{-5}$ mol per mol of silver, photographic characteristics having higher sensitivity and high $\gamma$ can be obtained. Specific examples of iridium compounds for use in such a case are iridium trichloride, iridium tetrachloride, potassium hexachloroiridate(II), potassium hexachloroiridate(IV), ammonium hexachloroiridate(III), etc.

Also, by using a rhodium salt or a complex salt thereof in an amount of preferably $10^{-8}$ to $10^{-4}$ mol, more preferably $5\times10^{-7}$ to $5\times10^{-5}$ mol, per mol of silver, the contrast of the silver halide emulsion can be increased to improve the image quality. Specific examples thereof are rhodium dichloride, rhodium trichloride, rhodium(III) potassium hexachloride, rhodium(III) ammonium hexachloride, etc, As a system for reacting a soluble silver salt and a soluble halide, a single jet method, a double jet method, or a combination thereof may be used.

A so-called back mixing method for forming silver halide grains in the presence of excessive silver ions can be also employed.

As one of the double jet method, a so-called controlled double jet method by keeping a constant pAg in a liquid phase and forming silver halide therein can be used and by this method, a silver halide emulsion containing silver halide grains having a regular crystal form and almost uniform grain size are obtained.

Details of silver halide emulsions and the preparation methods thereof are described in *Research Disclosure,* Vol. 176, Item 17643, pp 22–23 (December, 1978) or the original literature references cited therein.

The polyalkylene oxide compounds for use in Method (3) are described below.

The polyalkylene oxide compound for use in this invention includes the condensation products of polyalkylene oxides composed of at least 10 units of alkylene oxide having 2 to 4 carbon atoms, such as ethylene oxide, propylene-1,2-oxide, butylene-1,2-oxide, etc., preferably ethylene oxide, and a compound having at least one active hydrogen, such as water, an aliphatic alcohol, an aromatic alcohol, a fatty acid, an organic amine, a hexitol derivative, etc., and block copolymers of two or more kinds of polyalkylene oxides. Specific examples of polyalkylene compounds are:

polyalkylene glycols,
polyalkylene glycol alkyl ethers
polyalkylene glycol aryl ethers,
polyalkylene glycol alkylaryl ethers,
polyalkylene glycol ethers,
polyalkylene glycol fatty acid amides,
polyalkylene glycol amines,
polyalkylene glycol block copolymers,
polyalkylene glycol graft polymers, etc.

The polyalkylene oxide compound may contain not only one but also two or more polyalkylene oxide chains in the molecule thereof. In this case, each polyalkylene oxide chain may be composed of less than 10 alkylene oxide units but the sum of the alkylene oxide units in the polyalkylene oxide compound molecule must be at least 10. When the molecule of the compound has two or more polyalkylene oxide chains, each chain may be composed of different alkylene oxide units, e.g., ethylene oxide and propylene oxide. The polyalkylene oxide compound for use in this invention preferably contains 14 to 100 alkylene oxide units.

Specific examples of polyalkylene oxide compounds which can be used in this invention are illustrated below but the invention is not to be construed as being limited to these compounds.

$HO(CH_2CH_2O)_{10}H$ III-1

$C_{12}H_{25}O(CH_2CH_2O)_{15}H$ III-2

III-3

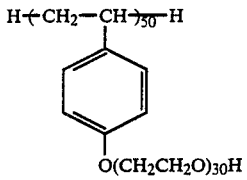

$C_8H_{17}CH{=}CHC_8H_{16}O(CH_2CH_2O)_{15}H$ III-4

III-5

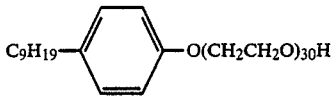

$C_{11}H_{23}COO(CH_2CH_2O)_{80}H$ III-6

$C_{11}H_{23}CONH(CH_2CH_2O)_{15}H$ III-7

III-8

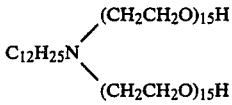

$C_{14}H_{29}N(CH_2)(CH_2CH_2O)_{24}H$ III-9

$H(CH_2CH_2O)_a(CH(CH_3)CH_2O)_b(CH_2CH_2O)_cH$ III-10

$a + b + c = 50$
$b/(a + c) = 10/9$

The addition amount of the polyalkylene oxide compound is preferably from $10^{-4}$ to $10^{2}$ g, particularly preferably from $10^{-3}$ to $10^{1}$ g, per mol of silver halide.

The lith emulsion for use in Method (3) described above is explained below.

As the silver halide composition, silver chlorobromide or silver chloroiodobromide containing at least 60 mol% (preferably at least 75 mol%) of silver chloride and containing 0 to 5 mol% silver iodide is preferred. There are no particular restrictions as to the form, crystal habit, grain size distribution, etc., of the silver halide crystals but silver halide grains having grain sizes of less than 0.7 $\mu$m are preferred.

The form of the silver halide grains may be tabular, spherical, cubic, tetradecahedral, octahedral, etc. Also, a narrow grain size distribution is preferred and a so-called mono-dispersed silver halide emulsion wherein about 90%, preferably about 95%, of the total silver halide grain numbers are in the grain size range of $\pm$40% of the mean grain size is preferred.

The silver halide emulsion may be sensitized by a gold compound such as a chloroaurate, gold trichloride, etc., a salt of a noble metal such as rhodium, iridium, etc., a sulfur compound forming silver sulfate by reacting with a silver salt, a reducing material such as a stannous salt, and amine, etc., without coarsening the grains.

Also, during the physical ripening or the nucleus formation of the silver halide grains, a salt of a noble metal such as rhodium, iridium, etc., or an iron compound such as potassium ferricyanide, etc., may be present.

As the silver halide emulsion which does not contain the polyalkylene oxide compound, the silver halide emulsions for use in Methods (1) and (2) described above can also be used alone or as a mixture thereof. Furthermore, a lith emulsion which does not contain any polyalkylene oxide compound can be also used.

When a hydrazine derivative is used for increasing the contrast of the silver halide emulsion layer as described in Method (1) above, it is preferred to incorporate a quinone scavenger in a silver halide emulsion layer containing substantially no hydrazine derivative or other hydrophilic colloid layer since in this case, the exposure latitude can be broadened even further.

In this case, the term "containing substantially no hydrazine derivative" means that the emulsion may contain a hydrazine derivative to an extent the above-described purposes are not deteriorated or destroyed.

It is assumed that the action of the quinone scavenger is to prevent the occurrence of infection between the contrast emulsion layer containing a hydrazine derivative and the soft tone emulsion layer containing no hydrazine derivative so that these emulsion layers do not give influences on each other.

That is, the soft tone emulsion takes part in the gradation at the portion of the density lower than about 1.5 on the characteristic curve and when the development occurs at the toe portion of the characteristic curve in the emulsion, a quinone forms as the oxidation product of a developing agent. The quinone causes a reaction with a hydrazine derivative to form an active seed for an infectious development causing contrast development to occur. Accordingly, if the quinone diffuses from the soft tone emulsion layer into the contrast emulsion layer containing a hydrazine derivative, a contrast development occurs from the toe portion of the characteristic curve. However, by using a quinone scavenger for trapping the quinone in an interlayer or in the soft tone emulsion layer, the influence of the quinone on the contrast emulsion layer by the diffusion of the quinone thereinto is inhibited, whereby the exposure latitude of the light-sensitive material can be broadened.

A quinone scavenger is a compound capable of reacting with a quinone, i.e., a compound capable of reducing a quinone or addition to a quinone.

Suitable quinone scavengers for use in this invention include various reducing agents such as dihydroxybenzene derivatives, sulfites, organic sulfinic acids, N-substituted hydroxylamines, ascorbic acid or erythorbic acid and the derivatives of these acids, diol compounds and the derivatives thereof, etc.

It is preferred for the quinone scavenger to be locally present in a specific layer of the silver halide photographic material and from this point, it is preferred that a non-diffusible group is introduced into the quinone scavenger from freely moving between layers or that a group accelerating the adsorption to silver halide grains is introduced into the quinone scavenger and the quinone scavenger is used in the state adsorbed onto silver halide grains. In this case, as the non-diffusible group, an organic group having at least 7 (preferably less than 20) carbon atoms is preferred. Also, as the adsorptive group for silver halide grains, a mercapto group, a thiocarbonyl group, or a group having a benzotriazole skeleton or an indazole skeleton is preferred.

Quinone scavengers for use in this invention are described in detail below.

Preferred dihydroxybenzene as quinone scavengers for use in this invention are the compounds represented by general formula (IV) shown below:

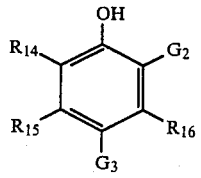

(IV)

wherein, at least one of $G_2$ and $G_3$ represents a hydroxy group and the other is selected from the group as defined below for $R_{14}$ to $R_{16}$; and $R_{14}$, $R_{15}$, and $R_{16}$ each represents a hydrogen aotm, a hydroxy group, a substituted or unsubstituted alkoxy group, a substituted or unsubstituted aryloxy group, a substituted or unsubstituted alkylthio group, a substituted or unsubstituted arylthio group, a halogen atom, a primary, secondary, or tertiary amino group, a substituted or unsubstituted carbonamido group, a substituted or unsubstituted sulfonamido group, a substituted or unsubstituted alkyl group, a substituted or unsubstituted aryl group, a substituted or unsubstituted 5- or 6-membered heterocyclic group containing at least one N, O, or S atom, a formyl group, a keto group, a sulfonic acid group, a carboxylic acid group, a substituted or unsubstituted alkylsulfonyl group, or a substituted or unsubstituted arylsulfonyl group, or two of $R_{14}$ to $R_{16}$ combine with each other to form a substituted or unsubstituted 5-, 6- or 7-membered ring, preferably a substituted or unsubstituted benzene ring; the sum of the carbon atoms of $R_{14}$ to $R_{16}$ being, however, at least 7 and these groups may be a part of a polymer chain having a number average polymerization degree of at least 3.

In these preferred dihydroxybenzenes, particularly preferred compounds are 1-substituted to 4-substituted catechols or hydroquinones, wherein the sum of the Hammett's $\sigma$ values of the substituents other than two hydroxy groups is in the range of from $-1.2$ to $+1.2$, preferably from $-1.0$ to $+0.5$.

Specific examples of these compounds are the mono-straight-chain alkylhydroquinones described in U.S. Pat. No. 2,728,659, Japanese Patent Application (OPI) No. 106329/74, the mono-branched alkylhydroquinones described in U.S. Pat. No. 3,700,453, West German Patent Application (OLS) No. 2,149,789, Japanese Patent Application (OPI) Nos. 156438/75, 106329/74, etc., the di-straight-chain alkylhydroquinones described in U.S. Pat. Nos. 2,728,659 and 2,732,300, British Pat. Nos. 752,146 and 1,089,208, *Chemical Abstracts,* Vol. 5, 6367h, etc., the di-branched alkylhydroquinones described in U.S. Pat. Nos. 3,700,453 and 2,732,300 British Pat. No. 1,086,208, Japanese Patent Application (OPI) Nos. 156438/75 and 55339/85, Japanese Patent Publication Nos. 21249/75 and 40818/81, *Chemical Abstracts,* Vol. 5, 6367h, etc., the dihydroxybenzene derivatives described in Japanese Patent Application (OPI) Nos. 109344/81, 22237/82, 202465/84 and 17431/83, Japanese Patent Publication Nos. 35012/84 and 37497/84, U.S. Pat. No. 3,227,552, etc., and the polymers having a dihydroxybenzene skeleton described in Japanese Patent Application (OPI) No. 17949/82, etc.

These compounds may be used alone or as a mixture thereof. These compounds can be easily produced by the methods described in French Pat. No. 1,496,562, West German Pat. No. 2,110,521, etc., or methods similar to these methods.
Specific examples of dihydroxybenzene derivatives having reduced diffusibility are illustrated below but the invention is not to be construed as being limited to these compounds.
IV-1
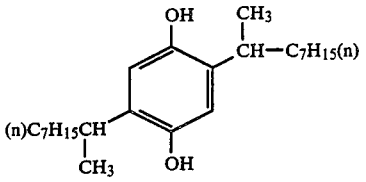
IV-2
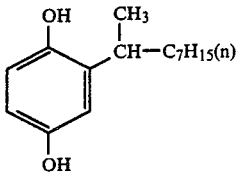
IV-3
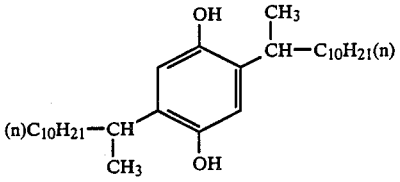
IV-4
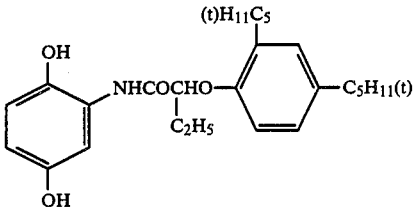
IV-5
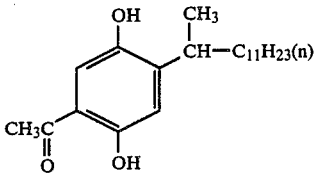
IV-6
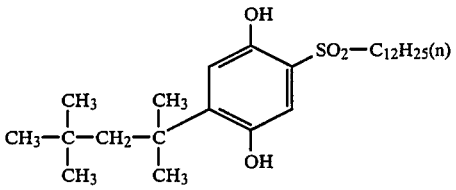
IV-7
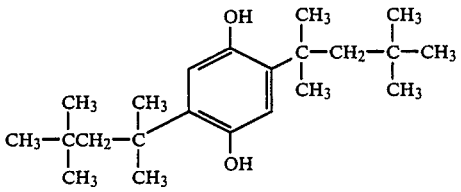
IV-8
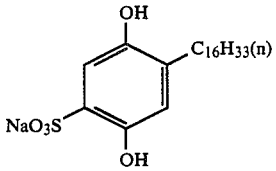
-continued
IV-9
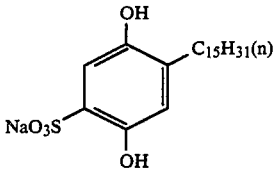
IV-10
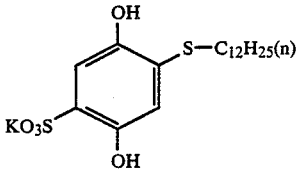
IV-11
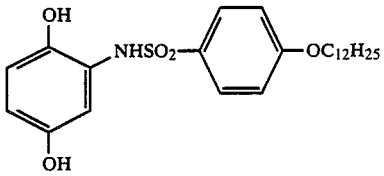
IV-12
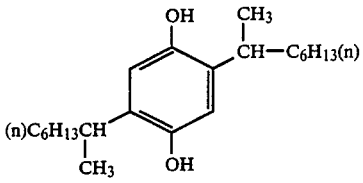
IV-13
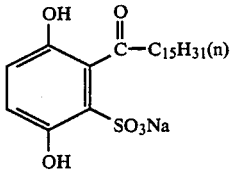
IV-14
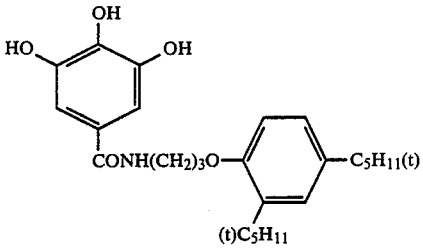
IV-15
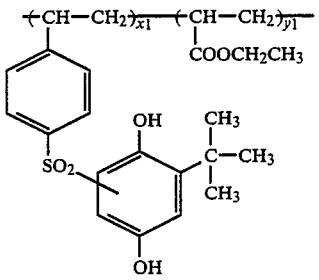
$x_1 + y_1 = 1500$
$x_1/y_1 = 7/3$ -continued

IV-16

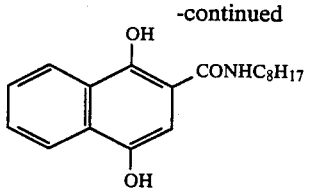

IV-17

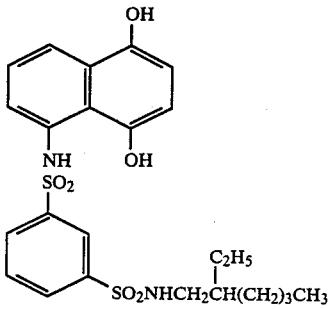

IV-18

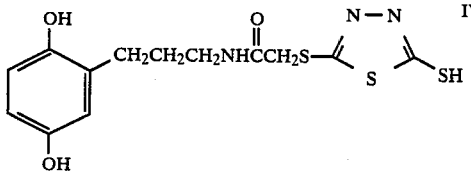

Preferred examples of sulfites which are used as quinone scavengers include sodium sulfite, potassium sulfite, lithium sulfite, ammonium sulfite, sodium bisulfite, potassium metabisulfite, sodium formaldehydebisulfite, etc.

Preferred organic sulfinic acids or the salts thereof which are used as quinone scavengers in this invention are the compounds represented by general formula (V) described below:

$$R_{17}—SO_2M_1 \qquad (V)$$

wherein, $M_1$ represents a hydrogen atom, an alkali metal atom, or an unsubstituted or mono- to tetra-substituted ammonium group; and $R_{17}$ represents a substituted or unsubstituted alkyl group having 1 to 30 carbon atoms, a substituted or unsubstituted phenyl group having 6 to 30 carbon atoms or a substituted or unsubstituted naphthyl group having 10 to 30 carbon atoms.

The preferred groups shown by $M_1$ in general formula (V) described above are a hydrogen atom or an alkali metal atom (e.g., lithium, sodium, potassium, cesium, etc.).

Also, examples of the preferred substituents for the groups shown by $R_{17}$ are a straight chain, branched, or cyclic alkyl group (preferably having 1 to 20 carbon atoms), an aralkyl group (preferably a monocyclic or bicyclic aralkyl group, the alkyl moiety having 1 to 3 carbon atoms), an alkoxy group (preferably 1 to 20 carbon atoms), a mono- or di-substituted amino group (preferably, substituted by an alkyl group having 1 to 20 carbon atoms, an acyl group, an alkylsulfonyl group, or an arylsulfonyl group, and the total number of carbon atoms in the substituents in the case of di-substituted amino group being less than 20), a mono- to tri-substituted or unsubstituted ureido group (preferably having 1 to 20 carbon atoms), a substituted or unsubstituted aryl group (preferably, monocyclic or bicyclic aryl group having 6 to 29 carbon atoms), a substituted or unsubstituted arylthio group (preferably having 6 to 29 carbon atoms), a substituted or unsubstituted alkylthio group (preferably having 1 to 29 carbon atoms), a substituted or unsubstituted alkylsulfinyl group (preferably having 1 to 29 carbon atoms), a substituted or unsubstituted arylsulfinyl group (preferably a monocyclic or bicyclic group having 6 to 29 carbon atoms), a substituted or unsubstituted alkylsulfonyl group (preferably having 1 to 29 carbon atoms), a substituted or unsubstituted arylsulfonyl group (preferably a monocyclic or bicyclic group having 6 to 29 carbon atoms), an aryloxy group (preferably a monocyclic or bicyclic group having 6 to 29 carbon atoms), a carbamoyl group (preferably having 1 to 29 carbon atoms), a sulfamoyl group (preferably having 1 to 29 carbon atoms), a hydroxy group, a halogen atom (e.g., fluorine, chlorine, bromine, iodine, etc.), a sulfonic acid group, a carboxylic acid group, etc.

The above-described substituents may have, if they can have, further a substituent such as, for example, an alkyl group (having 1 to 20 carbon atoms), an aryl group (a monocyclic or bicyclic aryl group having 6 to 20 carbon atoms), an alkoxy group (having 1 to 20 carbon atoms), an aryloxy group (having 6 to 20 carbon atoms), an alkylthio group (having 1 to 20 carbon atoms), an arylthio group (having 6 to 20 carbon atoms), an alkylsulfonyl group (having 1 to 20 carbon atoms), an arylsulfonyl group (having 6 to 20 carbon atoms), a carbonamido group (having 1 to 20 carbon atoms), a sulfonamido group (having up to 20 carbon atoms), a carbamoyl group (having 1 to 20 carbon atoms), a sulfamoyl group (having 1 to 20 carbon atoms), an alkylsulfinyl group (having 1 to 20 carbon atoms), an arylsulfinyl group (having 1 to 20 carbon atoms), an ester group (having 2 to 20 carbon atoms), a nitro group, a hydroxy group, $—COOM_2$ or $—SO_2M_2$ (wherein, $M_2$ represents a hydrogen atom, an alkali metal atom or a substituted or unsubstituted ammonium group), and a halogen atom (e.g., fluorine, chlorine, bromine, iodine, etc.). These groups may combine with each other to form a ring (e.g., a cyclopentane ring, a cyclohexane ring, a substituted or unsubstituted benzene ring, a morpholine ring, a piperazine ring, etc.). Also, these groups may be a part of a homopolymer chain or a copolymer chain.

Specific example of organic sulfinic acids which can be used in this invention are illustrated below but the invention is not to be construed as being limited to these compounds.

V-1

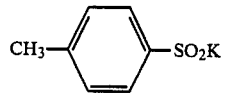

V-2

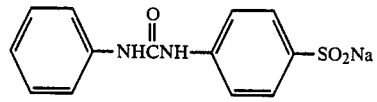

V-3

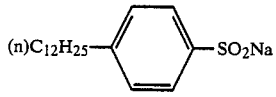

V-4

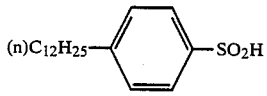

-continued

V-5

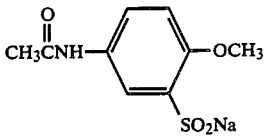

V-6

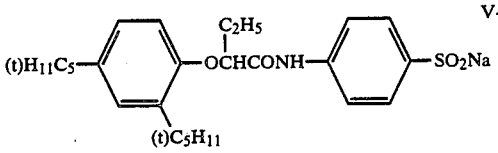

V-7

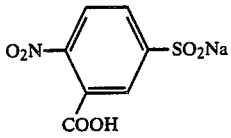

V-8

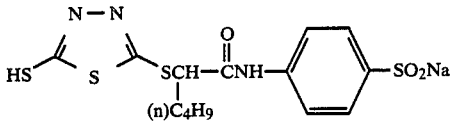

V-9

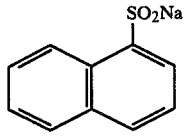

V-10 $(n)C_8H_{17}SO_2Na$

V-11

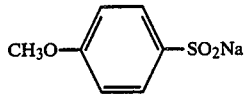

V-12

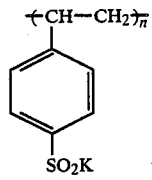

n = 6000

V-13

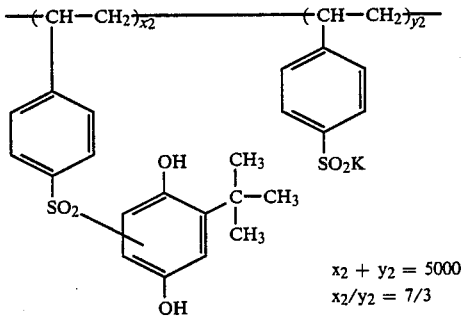

$x_2 + y_2 = 5000$ $x_2/y_2 = 7/3$

Methods of synthesis of these compounds are described, for example, in R. B. Wagner and H. D. Zook, *Synthetic Organic Chemistry*, pp 807–810, published by John Wiley & Sons, Inc., New York (1953).

Preferred N-substituted hydroxylamines as quinone scavengers for use in this invention are the compounds represented by general formula (VI)

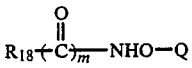

(VI)

wherein, m represents 0 or 1, Q represents hydrogen atom, an acyl group having 1 to 20 carbon atoms, or a substituted or unsubstituted phenyl group having 6 to 20 carbon atoms; and $R_{18}$ represents a substituted or unsubstituted alkyl group having 1 to 30 carbon atoms or a substituted or unsubstituted phenyl group having 6 to 30 carbon atoms; at least one of said Q and $R_{18}$ being, however, an organic group having 7 to 30 carbon atoms.

In the preferred compounds shown by general formula (VI) described above, m represents 0 or 1 and Q represents a hydrogen atom. Also, preferred examples of substituents for the alkyl group and phenyl group shown by $R_{18}$ are a straight chain, branched, or cyclic alkyl group (preferably having 1 to 20 carbon atoms), an aralkyl group (preferably, a monocyclic or bi-cyclic group, the alkyl moiety having 1 to 3 carbon atoms), an alkoxy group (preferably having 1 to 20 carbon atoms), a mono- or di-substituted amino group (preferably, an amino group (preferably an amino group substituted by an alkyl group having 1 to 20 carbon atoms, an acyl group, an alkylsulfonyl group, or an arylsulfonyl group, the total number of the carbon atoms of the substituents in the case of the bi-substituted group being less than 20), a mono- to tri-substituted or unsubstituted ureido group (preferably having 1 to 29 carbon atoms), a substituted or unsubstituted aryl group (preferably a monocyclic or bicyclic group having 6 to 29 carbon atoms), a substituted or unsubstituted arylthio group (preferably, having 6 to 29 carbon atoms), a substituted or unsubstituted alkylthio group (preferably having 1 to 29 carbon atoms), a substituted or unsubstituted alkylsulfinyl group (preferably, having 1 to 29 carbon atoms), a substituted or unsubstituted arylsulfinyl group (preferably a monocyclic or bicyclic group having 6 to 29 carbon atoms), an alkylsulfonyl group (preferably having 1 to 29 carbon atoms), a substituted or unsubstituted arylsulfonyl group (preferably a monocyclic or bicyclic group having 6 to 29 carbon atoms), an aryloxy group (preferably monocyclic or bicyclic group having 6 to 29 carbon atoms), a carbamoyl group (preferably having 1 to 29 carbon atoms), a sulfamoyl group (preferably having 1 to 29 carbon atoms), a hydroxy group, a halogen atom (e.g., fluorine, chlorine, bromine, iodine, etc.), a sulfonic acid group, a carboxylic acid group, etc.

These substituents may further have, if they can have, a substituent such as an alkyl group (having 1 to 20 carbon atoms), an aryl group (a monocyclic or bicyclic aryl group having 6 to 20 carbon atoms), an alkoxy group (having 1to 20 carbon atoms), an aryloxy group (having 6 to 20 carbon atoms), an alkylthio group (having 1 to 20 carbon atoms), an arylthio group (having 6 to 20 carbon atoms), an alkylsulfonyl group (having 1 to 20 carbon atoms), an arylsulfonyl group (having 6 to 20 carbon atoms), a carbonamido group (having 1 to 20 carbon atoms), a sulfonamido group (having up to 20 carbon atoms), a carbamoyl group (having 1 to 20 carbon atoms), a sulfamoyl group (having 1 to 20 carbon atoms), an alkylsulfinyl group (having 1 to 20 carbon atoms), an arysulfinyl group (having 1 to 20 carbon atoms), an ester group (having 2 to 20 carbon atoms), a hydroxy group, $—COOM_3$ or $—SO_2M_3$ (wherein $M_3$ represents a hydrogen atom, an alkali metal atom, or a substituted or unsubstituted ammonium group), and a halogen atom (e.g., fluorine, chlorine, bromine, and iodine).

Examples of these compounds are described, for example, in R. B. Wagner and H. D. Zook, *Synthetic Organic Chemistry*, pp 556–576, supra, together with the synthesis methods therefor.

Specific examples of these N-substituted hydroxylamines are illustrated below but the invention is not to be construed as being limited to these compounds.

$CH_3(CH_2)_{10}CONHOH$ VI-1

$(n)C_{15}H_{31}CONHOH$ VI-2

$(n)C_{12}H_{25}NHOH$ VI-3

$(n)C_{17}H_{34}CONHOH$ VI-4

VI-5

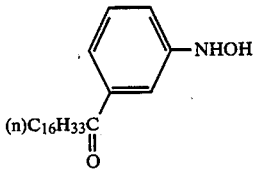

VI-6

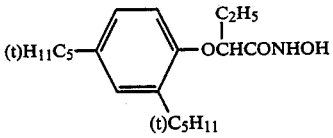

VI-7

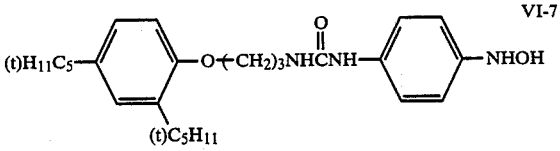

VI-8

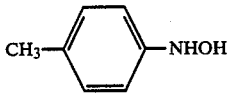

VI-9

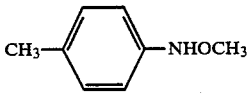

VI-10

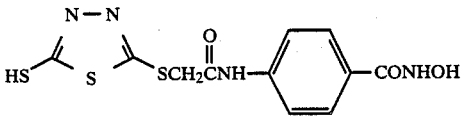

Other reducing materials which can be used as the quinone scavengers in this invention are, for example, ascorbic acid, erythorbic acid and the derivatives thereof, and the diol compounds described in British Pat. No. 922,550.

Specific examples of these reducing materials are illustrated below but the invention is not to be construed as being limited to these compounds.

VII-1

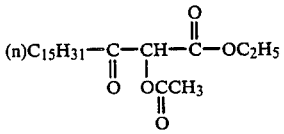

VII-2

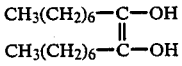

-continued

VII-3

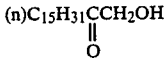

VII-4

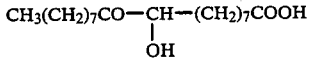

VII-5

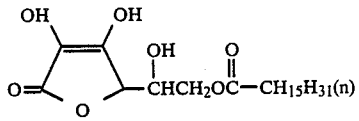

In this invention, the quinone scavenger may not be present in a same layer containing a hydrazine derivative. If the quinone scavenger is present in the silver halide emulsion layer containing a hydrazine derivative, it undesirably hinders the contrast-increasing action based on the hydrazine derivative.

The quinone scavenger for use in this invention may be incorporated in a hydrophilic colloid layer such as an interlayer, a filter layer, a protective layer, a subbing layer, etc., in addition or in place of a silver halide emulsion layer which does not contain a hydrazine derivative. It is preferred that the quinone scavenger be incorporated in a silver halide emulsion layer which does not contain a hydrazine derivative (e.g., a soft tone emulsion layer) or an interlayer between silver halide emulsion layers (for example, between a soft tone emulsion layer and a contrast emulsion layer containing a hydrazine derivative) and the latter case is particularly preferred.

The addition amount of the quinone scavenger is preferably from 0.001 to 1.0 $g/m^2$, more preferably from 0.01 to 0.5 $g/m^2$.

An interlayer may be or may not be employed and where an interlayer is employed, the thickness thereof is preferably from 0.1 to 3.0 μm, more preferably from 0.2 to 2.0 μm. The interlayer is composed of mainly of a hydrophilic colloid (preferably gelatin).

The light-sensitive material for use in this invention may contain various compounds for preventing the formation of fog during the production, storage and photographic processing of the light-sensitive material or stabilizing the photographic performance thereof. For example, antifoggants or stabilizers, for example, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds such as oxazolinethione, etc.; azaindenes such as triazaindenes, tetraazaindenes (in particular, 4-hydroxy-substituted (1,3,3a,7)tetraazaindenes), pentaazaindenes, etc.; benzenethiosulfonic acid, benzenesulfinic acid, benzenesulfonic acid amide, etc., may be used.

The photographic emulsion layers and the light-insensitive hydrophilic colloid layer(s) used in this invention may further contain an inorganic or organic hardening agent such as a chromium salt (chromium alum, chromium acetate, etc.), an aldehyde (e.g., formaldehyde, glyoxal, glutaraldehyde, etc.), an N-methylol compound (e.g., dimethylolurea, methyloldimethylhydantoin, etc.), a dioxane derivative (e.g., 2,3-dihydroxydioxane, etc.), an active vinyl compound (e.g., 1,3,5-triacryloyl-hexahydro-s-triazine, bis(vinylsulfonyl)methyl ether, N,N'-methylene-bis[β-(vinylsulfonyl)propionamido], etc.), an active halogen compound (e.g., 2,4-dichloro-6-hydroxy-s-triazine, etc.), a mucohalogenic acid (e.g., mucochloric acid, mucophenoxychloric acid, etc.), an iso-oxazole, dialdehyde starch, 2-chloro-6-hydroxytriazinylated gelatin, etc. These compounds may be usd alone or as a combination thereof.

Specific examples of these compounds are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427, Japanese Patent Publication Nos. 7133/59 and 1872/71, Japanese Patent Application (OPI) Nos. 41221/78, 57257/78, 162546/84 and 80846/85, etc.

In these compounds, the active vinyl compounds described in the above described Japanese Patent Applications (OPI) and the active halides described in U.S. Pat. No. 3,325,287 are preferred.

As a binder or a protective colloid for the photographic emulsions, gelatin is advantageously used but other hydrophilic colloids can be also used. For example, proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc., sugar derivatives such as sodium alginate, starch derivatives, etc.; and various synthetic hydrophilic homopolymers and copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used.

Limed gelatin and also acid-treated gelatin may be used as the gelatin. Furthermore, hydrolyzed products of gelatin and enzyme decomposition products of gelatin can be also used.

The light-sensitive materials for use in this invention may further contain, in the photographic emulsion layers or other hydrophilic colloid layers, various kinds of surface active agents for the purposes of coating aids, static prevention, the improvement of slidability, the improvement of dispersibility, adhesion prevention, and the improvement of photographic properties (e.g., the acceleration of development and the increase of contrast and sensitivity).

Examples of surface active agents are nonionic surface active agents such as saponin (steroid series), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group (e.g., carboxy group, sulfo group, phospho group, sulfuric acid ester group, phosphoric acid ester group, etc.), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium, imidazolium, etc., and phosphonium salts or sulfonium salts containing aliphatic groups or heterocyclic rings, etc.

Particularly preferred surface active agents used in this invention are polyalkylene oxides having a molecular weight of at least 600 as described in Japanese Patent Publication No. 9412/83. When the surface active agent is used as an antistatic agent, a fluorine-containing surface active agent is particularly preferred.

The photographic light-sensitive materials for use in this invention may further contain, in the photographic emulsion layers and other hydrophilic colloid layers, matting agents such as silica, magnesium oxide, polymethyl methacrylate, etc., for adhesion prevention.

The light-sensitive materials for use in this invention can further contain a dispersion of a water insoluble or water sparingly soluble synthetic polymer for the purpose of improving dimensional stability, etc. For example, homopolymers or copolymers of alkyl(meth)acrylate, alkoxyalkyl(meth)acrylate, glycidyl(meth)acrylate, (meth)acrylamide, vinyl esters (e.g., vinyl acetate), acrylonitrile, olefins, styrene, etc., alone or as a combination thereof, or a combination of the above described monomer and acrylic acid, methacrylic acid, α,β-unsaturated dicarboxylic acid, hydroxyalkyl(meth)acrylate, sulfoalkyl(meth)acrylate, styrenesulfonic acid, etc. Examples of these polymers are described in U.S. Pat. Nos. 2,376,005, 2,739,137, 2,853,457, 3,062,674, 3,411,911, 3,488,708, 3,525,620, 3,607,290, 3,635,715 and 3,645,740, British Pat. Nos. 1,186,699 and 1,307,373, etc.

It is preferred for the photographic light-sensitive materials for use in this invention to contain a compound having an acid group in the silver halide emulsion layers or other hydrophilic colloid layers. Examples of such a compound having an acid group are organic acids such as salicylic acid, acetic acid, ascorbic acid and polymers or copolymers having an acid monomer such as acrylic acid, maleic acid, phthalic acid, etc., as a recurring unit. For these compounds, the descriptions of Japanese Patent Application Nos. 66179/85 (corresponding to U.S. patent application Ser. No. 845,298 filed Mar. 28, 1986), 68873/85 (corresponding to U.S. patent application Ser. No. 846,679 filed Apr. 1, 1986), 163856/85, and 195655/85 (corresponding to U.S. patent application Ser. No. 904,062 filed Sept. 4, 1986) can be referred.

Particularly preferred compounds of these compounds are ascorbic acid as a low molecular weight compound and a water-dispersible latex of a copolymer composed of an acid monomer such as acrylic acid, etc., and a crosslinking monomer having at least 2 unsaturated groups such as divinylbenzene, as a high molecular weight compound.

The silver halide emulsions for use in this invention can be subjected to an orthochromatic or panchromatic spectral or super color sensitization using cyanine dyes such as cyanine, merocyanine, carbocyanine, etc., alone or as a combination thereof or by using the cyanine dye in combination with styryl dye(s). Particularly, the sensitizing dyes described in Japanese Patent Application (OPI) Nos. 95836/76 and 18311/77, and U.S. Pat. No. 3,567,458 are preferably used for the above-described purpose. Also, the sensitizing dyes disclosed in *Research Disclosure,* RD No. 17643, Paragraph IV (December, 1978) or the original literature references cited therein can be used.

For the silver halide photographic materials for use in this invention, various kinds of additives can be present. For example, desensitizers, coating aids, antistatic agents, plasticizers, sliding agents, development accelerators, oils, dyes, etc. can be present.

These additives are described, for example, in *Research Disclosure,* RD No. 17643, pp 22–31 (December, 1978), etc.

The photographic light-sensitive material for use in this invention has photographic emulsion layers and other hydrophilic colloid layer(s) on one or both surfaces of a flexible support. Films composed of a synthetic polymer such as cellulose acetate, cellulose acetate butyrate, polystyrene, polyethylene terephthalate, etc., are useful as the flexible support.

As processing solutions such as developer, etc., known processing solutions can be used in this invention, such as a developer giving a contrasty gradation (the region of from 1.5 to 3.0D (density) of the characteristic curve) and a soft tone gradation (the region of from 0.3 to 1.5D) by one kind of developer.

Specifically, the developer for use in this invention may be selected from a PQ developer, an MQ developer, and a lith developer as follows.

That is, the developer may be selected depending on the kind and sensitivity of the light-sensitive materials to be processed, the kind and sensitivity of the contrast-increasing system employed.

Details of the development process for use in this invention are described in *Research Disclosure,* Vol. 176, RD No. 17643, Paragraphs XIX, XX, and XXI, pp 28–30 (December, 1978).

The developers which are used in Methods (1) and (2) described above are explained below.

For obtaining extremely high contrasty photographic characteristics ($\gamma$ value of at least 10) by using a silver halide photographic material using a hydrazine derivative or a tetrazolium compound, it is unnecessary to use a conventional unstable lith developer (infectious developer) and a stable developer can be used. That is, the above-described photographic characteristics can be obtained by processing the above-described silver halide photographic material with a developer containing a sufficient amount (in particular, higher than 0.15 mol/liter) of sulfite ion. The pH of the developer is preferably at least 9.5, particularly from 10.5 to 12.3, in the case of using a hydrazine derivative, and is preferably from 9 to 12, particularly from 10 to 11, in the case of using a tetrazolium compound.

There is no particular restriction on the developing agent for the developer which is used in Methods (1) and (2) but the use of a dihydroxybenzene is preferred from the point of ease of obtaining good dot quality. A combination of a dihydroxybenzene and a 1-phenyl-3-pyrazolidone or a combination of a dihydroxybenzene and a p-aminophenol may be used.

Hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc. may be used as the dihydroxybenzene developing agent for use in Methods (1) and (2). In these materials, hydroquinone is particularly preferred in this invention.

Examples of 1-phenyl-3-pyrazolidone and derivatives thereof which can be used as the developing agent together with the dihydroxybenzene are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

Examples of a p-aminophenol which can be used as the developing agent together with the dihydroxybenzene are N-methyl-p-aminophenol, p-aminophenol, N-($\beta$-hydroxyethyl)-p-aminophenol, N-(4-hydroxyphenyl)glycine, 2-methyl-p-aminophenol, p-benzylaminophenol, etc. In these materials, N-methyl-p-aminophenol is preferred.

It is preferred that the developing agent be used in an amount of from 0.05 mol/liter to 0.8 mol/liter. Also, the developing agent can be composed of a combination of a dihydroxybenzene and a 1-phenyl-3-pyrazolidone or a combination of a dihydroxybenzene and a p-aminophenol, it is preferred that the amount of the dihydroxybenzene is from 0.05 mol/liter to 0.5 mol/liter and the amount of the pyrazolidone or the p-aminophenol is from less than about 0.06 mol/liter.

Sodium sulfite, potassium sulfite, lithium sulfite, ammonium sulfite, sodium hydrogensulfite, potassium metahydrogensulfite, potassium metahydrogensulfite, sodium formaldehyde hydrogensulfite, etc. can be used as sulfite preservatives for use in Methods (1) and (2). The amount of the sulfite is preferably at least 0.4 mol/liter, particularly preferably at least 0.5 mol/liter. The upper limit thereof is preferably 2.5 mol/liter.

Alkali agents for adjusting the pH of the developer include pH controlling agents and buffers, such as sodium hydroxide, potassium hydroxide, sodium carbonate, potassium carbonate, sodium tertiary phosphate, potassium tertiary phosphate, etc.

The developers for use in Methods (1) and (2) may further contain various additives in addition to the above-described materials. Examples of these additives are development inhibitors such as boric acid, borax, sodium bromide, potassium bromide, potassium iodide, etc.; organic solvents such as ethylene glycol, diethylene glycol, triethylene glycol, dimethylformamide, methyl cellosolve, hexylene glycol, ethanol, methanol, etc.; and antifoggants or "black pepper" preventing agents such as mercapto series compounds (e.g., 1-phenyl-5-mercaptotetrazole, sodium 2-mercaptobenzimidazole-5-sulfonate, etc.), indazole series compounds (e.g., 5-nitroindazole, etc.), benzotriazole series compounds (e.g., 5-methylbenzotriazole, etc.), etc.

Furthermore, the developers may contain, if desired, toning agents, surface active agents, defoaming agents, water softeners, hardening agents, the amino compounds described in Japanese Patent Application (OPI) No. 106244/81, etc.

It is preferred that the development temperature be from 18° C. to 50° C. and the development time be from 15 to 60 seconds in Methods (1) and (2).

The lith developer for use in Method (3) described above is explained below.

The lith developer which is preferably used in this invention is fundamentally comprised of o- or p-dihydroxybenzene, an alkali agent, a small amount of a free sulfite, and a sulfite ion buffer.

The o- or p-dihydroxybenzene as a developing agent can be suitably selected from known agents. Specific examples of dihydroxybenzenes are hydroquinone, chlorohydroquinone, bromohydroquinone, isopropylhydroquinone, toluhydroquinone, methylhydroquinone, 2,3-dichlorohydroquinone, 2,5-dimethylhydroquinone, etc. Of these materials, hydroquinone is particularly preferred. These developing agents may be used alone or as a mixture thereof.

The addition amount of the developing agent is from 1 to 10 g, preferably from 5 to 80 g, per liter of the developer.

A sulfite ion buffer is used in an amount effective for maintaining the sulfite concentration in the developer at an almost constant value and examples thereof are a aldehyde-alkali hydrogensulfite addition product such as a formaldehyde-sodium hydrogensulfite addition product, etc.; a ketone-alkali hydrogensulfite addition product such as an acetone-sodium hydrogensulfite addition product, etc., a carbonyl hydrogensulfite-amine condensation produce such as sodium-bis(2-hydroxyethyl)aminomethane sulfonate, etc. The amount of the sulfite ion buffer is from 13 to 130 g per liter of developer.

To the developer for use in Method (3) can be added an alkali sulfite such as sodium sulfite, etc., for controlling the free sulfite ion concentration. The addition amount thereof is generally less than about 5 g, preferably less than 3 g, per liter of developer but may be, as a matter of course, larger than 5 g per liter of developer.

In many cases, it is preferred that the developer contain an alkali halide (in particular, a bromide such as sodium bromide, potassium bromide, etc.) as a development controlling agent. The amount of the alkali halide is from 0.01 to 10 g, preferably from 0.1 to 5 g, per liter of developer.

The developer usually contains an alkali agent such as sodium carbonate, potassium carbonate, etc., in various amounts so as to adjust the pH of the developer to 9 or more, preferably 9.7 to 11.5.

The developers for use in Method (3) may contain, if desired, pH buffers such as water-soluble acids (e.g., acetic acid, boric acid, etc.), alkalis (e.g., sodium hydroxide, etc.), salts (e.g., sodium carbonate, etc.), etc. Certain alkalis function not only as an alkalifying agent for developer but also as a pH buffer and a development controlling agent. Other components which can be further added to the developers are preservatives such as diethanolamine, ascorbic acid, kojic acid, etc., antifoggants such as benzotriazole, 1-phenyl-5-mercaptotetrazole, etc., organic solvent such as triethylene glycol, dimethylformamide, methanol, etc.

The developer may contain the necessary components as described above at use and the composition of the developer may be divided into two or more components before use. For example, if the developer is divided into a portion containing a developing agent and a portion containing an alkali, they can be stably stored and can be immediately used by mixing both the portions with dilution at use.

As a matter of course, by using a powder type developer or a liquid type developer, good photographic performance can be obtained.

In Method (3), the developer temperature is preferably from 20° C. to 40° C. but other temperature than above may be employed. The development time is depends upon the development temperature but is from 10 seconds to 250 seconds, preferably from 10 seconds to 150 seconds.

The following examples are intended to illustrate the present invention more specifically but not to be construed as limiting it in any way.

Unless otherwise indicated herein, all parts, percents, ratios and the like are by weight.

EXAMPLE 1

Silver chloroiodobromide emulsions (silver iodide 0.05 mol%, silver bromide 25 mol%) were prepared using a double jet method. By controlling the amount of $(NH_4)_3RhCl_6$ and the silver halide grain forming temperature so that the rhodium content and the mean silver halide grain sizes became as shown in Table 1 below, eight kinds of silver chloroiodobromide grains were formed. After washing these silver halide emulsions with water in a conventional manner to remove salts, gold and sulfur sensitizations were applied thereto. Then, the emulsions were spectrally sensitized by the addition of dimethinemerocyanine dye (I) and by adding thereto 2-methyl-4-hydroxy-1,3,3a,7-tetraazaindene as a stabilizer, a dispersion of 1,4-dihydroxybenzene and polyethyl acrylate, and 1,3-vinylsulfonyl-2-propanol, Emulsions A to H were prepared.

TABLE 1

| Emulsion No. | Grain-Forming Temperature | Amount of Rh (mol/Ag mol) | Mean grain size (μm) |
|---|---|---|---|
| A | 50° C. | $3.0 \times 10^{-7}$ | 0.28 |
| B | " | $1.5 \times 10^{-7}$ | " |
| C | " | $0.75 \times 10^{-7}$ | " |
| D | " | — | " |
| E | 60° C. | $2.0 \times 10^{-7}$ | 0.35 |
| F | " | $1.0 \times 10^{-7}$ | " |
| G | " | $0.5 \times 10^{-7}$ | " |
| H | " | — | " |

Also, by adding the non-diffusible nonionic surface active agent (II) to Emulsions B, C, E, and F in an amount that each emulsion showed the maximum $\gamma$ value when the lith development described hereinafter was applied to the emulsion, Emulsions I, J, K, and L were prepared, respectively. Furthermore, by adding a mixture of tetrazolium compound (III) and anionic surface active agent (IV) to Emulsions C, D, and H in an amount that each emulsion showed the maximum $\gamma$ value when the standard processing was applied to the emulsion with the developer described hereinbelow, Emulsions M, N, and O were prepared.

Each of the Emulsions A to O thus prepared was coated on a polyethylene terephthalate film at a silver coverage of 3.6 g/m$^2$ and then a protective layer of 1.0 g/m$^2$ of gelatin on the emulsion layer to provide Film Nos. 1 to 15, respectively. Each of these films thus prepared was subjected to step exposure in a conventional manner or to line image exposure by the method described hereinafter. Then, Film Nos. 1 to 12 were processed with lith developer HS-5 (made by Fuji Photo Film Co.) contained in an automatic processor FG-660 (made by Fuji Photo Film Co.) at the optimum development conditions (32° C., 60 seconds). Also, after applying the same exposure as above, Film Nos. 1 to 8 and 13 to 15 were processed with Developer (I) at 28° C. for 30 seconds. For some of the samples after processing, the characteristic curves were obtained on the samples subjected to the step exposure and from an exposure amount giving a density of 1.5, the sensitivities thereof (the sensitivity of Film No. 1 by HS-5 processing was defined as 100) and the $\gamma$ values thereof at a density (D) of from 0.3 to 1.5 and a density of 1.5 to 3.0 were measured (the measuring methods are described below in detail). On the other hand, on samples subjected to the line image exposure, the line image exposure latitude and real Dmax were evaluated as described below.

Gamma ($\gamma$) Value Measurement Method:

After exposing the samples described in Example through a sensitometric optical wedge to a tungsten light of a color temperature of 3200° K. for 5 seconds, they were processed as described in the Example.

The slope of the straight line connecting the point on the characteristic curve thus obtained at a density of 0.3 and the point thereof at a density of 1.5 was defined as $\gamma_L$ and the slope of the straight line connecting the point at a density of 1.5 and the point at a density of 3.0 was defined as $\gamma_H$.

Line Image Exposure Latitude Evaluation:

An original having white lines and black lines of 100 μm in width was prepared using handworking photocomposing paper PL-100WP (made by Fuji Photo Film Co.). In this case, the white lines were white line portions formed in a solid black background and the black lines were black line portions formed in a white background. It was confirmed that the width of each of these black lines and white lines at an optical density of 0.6 was 100 μm by scanning the original with a reflection type microdensitometer.

After photographing the original of handworked photocomposing paper with the white lines and the black lines thus obtained onto the samples prepared in the Example using a reflection type process camera, DSC-351 (made by Dainippon Screen Mfg. Co.), the samples where processed. In this case, the exposure time (sec.) of the process camera was changed, the threshold exposure amount for reproducing the white lines and the threshold exposure amount for reproducing the black lines were measured, and the difference between the two exposure amounts was employed as the exposure latitude. That is, as the exposure amount decreased, the width of the white lines (black lines on a negative film) of the original and the density thereof is decreased although the black lines (white lines on the negative film) of the original were reproduced, and there was found the lower limit of exposure amount lower than that at which the white lines were not reproduced. Also, similarly, as the exposure amount increased, there was found the upper limit of the exposure amount higher than that at which the images of the black lines were collapsed although the white lines of the original were reproduced well. The difference between the upper limit of the exposure amount and the lower limit of the exposure amount thus obtained ($\Delta$logE) was defined as the exposure latitude for line images. The threshold point of the white line and black line was defined to be that of the line width obtained by scanning a negative film after processing with a transmission type microdensitometer in the width direction and measurement at an optical density of 1.5 becomes lower than 10 μm (the line width which could not be used in the subsequent step).

In other words, the exposure latitude of line images was shown by log (A)−log (B), wherein (A) was the upper limit of exposure amount and (B) was the lower limit of exposure amount. It is preferred that the value of the exposure altitude of line image evaluated by the method be at least 0.8.

Real Dmax Evaluation Method:

The density of a solid black portion on a negative film processed is preferably higher. The density of the solid black portion causes difficulty at a low exposure amount side. The transmission density of the solid black portion at the threshold exposure amount (the lower limit of exposure amount) for reproducing the white lines of the original was measured wth a Macbeth densitometer TD-504 and the value was defined as "real Dmax".

It is preferred for the real Dmax to be at least 4.0.

The results obtained are shown in Table 2 below.

TABLE 2

| Sample No. | Emulsion No. | Sensitivity HS-5 Treatment | Sensitivity Developer (I) Treatment | $\gamma_L$ HS-5 | $\gamma_L$ I | $\gamma_H$ HS-5 | $\gamma_H$ I | Line Image Exposure Latitude HS-5 | Line Image Exposure Latitude I | Real Dmax HS-5 | Real Dmax I |
|---|---|---|---|---|---|---|---|---|---|---|---|
| 1 | A | 100 | 79 | 5.0 | 4.7 | 8.0 | 7.7 | 0.90 | 0.92 | 3.4 | 3.3 |
| 2 | B | 132 | 105 | 4.8 | 4.3 | 7.8 | 7.5 | 0.92 | 0.95 | 3.2 | 3.4 |
| 3 | C | 159 | 126 | 4.7 | 4.2 | 7.4 | 7.1 | 0.91 | 0.93 | 3.4 | 3.4 |
| 4 | D | 199 | 162 | 4.5 | 4.0 | 7.1 | 6.7 | 0.94 | 0.92 | 2.8 | 3.2 |
| 5 | E | 178 | 146 | 4.4 | 4.0 | 7.2 | 7.1 | 0.93 | 0.94 | 3.3 | 3.1 |
| 6 | F | 229 | 182 | 4.0 | 3.7 | 7.0 | 6.6 | 0.92 | 0.92 | 3.4 | 3.3 |
| 7 | G | 270 | 224 | 3.8 | 3.5 | 6.8 | 6.5 | 0.93 | 0.95 | 3.1 | 3.2 |
| 8 | H | 316 | 257 | 3.5 | 3.2 | 6.4 | 6.0 | 0.90 | 0.90 | 3.3 | 3.2 |
| 9 | I | 89 | — | 11.5 | — | 15 | — | 0.67 | — | 5.3 | — |
| 10 | J | 100 | — | 10.2 | — | 14 | — | 0.69 | — | 4.9 | — |
| 11 | K | 126 | — | 9.7 | — | 12.5 | — | 0.70 | — | 4.8 | — |
| 12 | L | 178 | — | 9.4 | — | 12 | — | 0.72 | — | 4.7 | — |
| 13 | M | — | 71 | — | 7.1 | — | 12 | — | 0.75 | — | 4.4 |
| 14 | N | — | 79 | — | 6.5 | — | 11 | — | 0.76 | — | 4.3 |
| 15 | O | — | 102 | — | 6.0 | — | 9.6 | — | 0.73 | — | 4.1 |

Sample Nos. 1 to 15 all have a single emulsion layer and are comparison examples.

It is preferred for the line image exposure latitude to be at least 0.8 and the real Dmax to be at least 4.0 as described above. Sample Nos. 1 to 8 have lower real Dmax and Sample Nos. 9 to 15 have lower line image exposure latitude, both situations being undesirable.

Sample Nos. 16 to 27 were prepared by forming double layers as shown in Table 3 below using the above-described emulsion layers as combinations thereof so that the silver coverage of each emulsion layer becomes 1.8 g/m$^2$. After exposing each sample as described above, the sample was subjected to HS-5 processing as above. The results obtained of these samples are shown in Table 3 below.

TABLE 3

| Sample No. | Emulsion No. Upper Layer | Emulsion No. Lower Layer | Sensitivity | $\gamma_L$ | $\gamma_H$ | Line Image Exposure Latitude | Real Dmax |
|---|---|---|---|---|---|---|---|
| 16 | A | I | 81 | 5.0 | 11 | 0.84 | 4.2 |
| 17 | " | J | 93 | 5.0 | 14 | 0.87 | 4.3 |
| 18 | " | K | 110 | 4.8 | 12 | 0.82 | 4.1 |
| 19 | " | L | 155 | 4.7 | 8.7 | 0.76 | 3.7 |
| 20 | I | A | 89 | 8.9 | 7.4 | 0.70 | 3.6 |
| 21 | J | " | 100 | 8.5 | 7.2 | 0.69 | 3.4 |
| 22 | K | " | 123 | 8.0 | 7.2 | 0.71 | 3.3 |
| 23 | L | " | 166 | 7.3 | 7.0 | 0.70 | 3.2 |
| 24 | K | C | 120 | 8.7 | 7.0 | 0.67 | 3.4 |
| 25 | " | D | 166 | 7.0 | 11 | 0.83 | 4.1 |
| 26 | " | G | 174 | 4.2 | 12.5 | 0.90 | 4.5 |
| 27 | " | H | 199 | 3.5 | 10.5 | 0.85 | 4.2 |

Sample Nos. 16 to 18 and 25 to 27 are samples of this invention and Sample Nos. 19 to 24 are comparison samples. As shown by the results in Table 3 above, the samples of this invention have good line image exposure latitude and good real Dmax.

The materials and the composition of the developer (I) used in the Example were as follows.

Dimethinemerocyanine Dye (I)

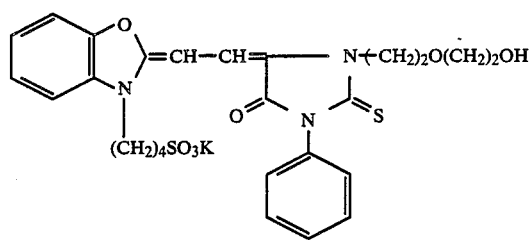

Nonionic Surface Active Agent (II) (Compound III-3)

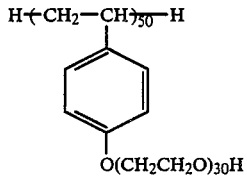

Tetrazolium Salt (III) (Compound II-3)

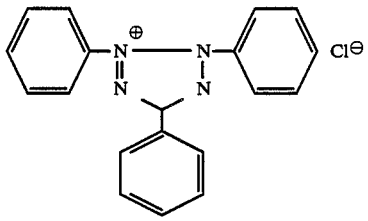

Anionic Surface Active Agent (IV)

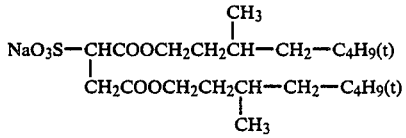

Composition of Developer (I):

| | |
|---|---|
| Ethylenediaminetetraacetic acid disodium salt (bi-hydrate) | 0.75 g |
| Potassium sulfite (anhydrous) | 51.7 g |
| Potassium carbonate (anhydrous) | 60.4 g |
| Hydroquinone | 15.1 g |
| 1-Phenyl-3-pyrazolidone | 0.51 g |

-continued

| | |
|---|---|
| Sodium bromide | 2.2 g |
| 5-Methylbenzotriazole | 0.124 g |
| 1-Phenyl-5-mercaptotetrazole | 0.018 g |
| 5-Nitroindazole | 0.106 g |
| Diethylene glycol | 98 g |
| Water to make | 1 liter (pH = 10.5) |

EXAMPLE 2

Sample Nos. 28 to 38 were prepared by forming double layers as shown in Table 4 below using the combinations of the emulsion layers as described in Example 1. Each sample was exposed as described in Example 1, developed with Developer I as shown in Example 1, and evaluated as described in Example 1. The results obtained are shown in Table 4 below.

TABLE 4

| Sample No. | Emulsion No. Upper Layer | Emulsion No. Lower Layer | Sensitivity | $\gamma_L$ | $\gamma_H$ | Line Image Exposure Latitude | Real Dmax |
|---|---|---|---|---|---|---|---|
| 28 | A | M | 72 | 4.7 | 10.5 | 0.83 | 4.0 |
| 29 | " | N | 72 | 4.8 | 12 | 0.88 | 4.2 |
| 30 | " | O | 76 | 5.6 | 9.5 | 0.75 | 3.6 |
| 31 | M | A | 69 | 7.0 | 7.3 | 0.70 | 3.4 |
| 32 | N | " | 76 | 6.3 | 7.0 | 0.72 | 3.3 |
| 33 | O | " | 96 | 5.8 | 6.8 | 0.71 | 3.4 |
| 34 | " | B | 100 | 5.8 | 7.3 | 0.68 | 3.2 |
| 35 | " | E | 138 | 5.4 | 7.0 | 0.74 | 3.3 |
| 36 | " | F | 170 | 4.2 | 10.5 | 0.81 | 4.1 |
| 37 | " | G | 204 | 3.9 | 11 | 0.85 | 4.2 |
| 38 | " | H | 240 | 3.5 | 9 | 0.68 | 3.7 |

In Table 4 above, Sample Nos. 28 and 29 and 36 and 37 are samples of this invention and Sample Nos. 30 to 35 and 38 are comparison samples. As shown by the results in the above table, the samples of this invention have braod line image exposure latitude and high real Dmax.

EXAMPLE 3

A cubic monodispersed silver halide emulsion having a mean grain size of 0.20 μm and a mean silver iodide content of 1 mol% was prepared by simultaneously adding an aqueous solution of silver nitrate and an aqueous solution of potassium iodide and potassium bromide to an aqueous gelatin solution kept at 50° C. in the presence of $4\times10^{-7}$ mol of potassium iridium(III) hexachloride per mol of silver and ammonia over a period of 60 minutes while maintaining the pAg at 7.8.

After sulfur-sensitizing the emulsion using sodium thiosulfate, the emulsion was further spectrally sensitized by the addition of a sensitizing dye, 5,5'-dichloro-3,3'-di(3-sulfopropyl)-9-ethyl-oxacarbocyanine sodium salt in an amount of $6\times10^{-4}$ mol per mol of silver. Furthermore, 4-hydroxy-6-methyl-1,3,3a,7-tetraazaindene was added as a stabilizer.

By adding thereto an alkylbenzenesulfonate as a surface active agent, 1,3-vinylsulfonyl-2-propanol as a hardening agent, $5\times10^{-3}$ mol/mol-Ag of compound I-12 as a hydrazine compound, and a dispersion of polyethyl acrylate, Emulsion P was prepared.

Mono-dispersed silver halide emulsions having a mean grain size of 0.25 μm and 0.30 μm, respectively were prepared using the same method as described above while changing the amount of ammonia during the formation of silver halide grains. By sulfur-sensitizing the emulsions and adding thereto the additives such as the sensitizing dye, etc., as in the case of producing Emulsion P, Emulsion Q (0.25 μm) and Emulsion R (0.30 μm) were prepared.

Each of Emulsions A to C and E to G as described in Example 1 and Emulsions P to R described above was coated on a polyethylene terephthalate support at a silver coverage of 3.6 g/m$^2$ and further an aqueous gelatin solution was coated on the emulsion layer as a protective layer at a gelatin coverage of 1 g/m$^2$ to provide Sample Nos. 39 to 47 as shown in Table 5 below.

The samples thus prepared were all single emulsion layer samples and comparison samples.

Then, double layer samples were prepared as follows. Sample Nos. 48 to 55 were prepared by coating one of Emulsions A to C and E to G as the upper layer (the layer farther from the support) and one of Emulsions P to R as the lower layer (the layer nearer the support) so that the silver coverage of each emulsion layer was 1.8 g/m$^2$ (the total silver coverage of the upper layer and the lower layer was 3.6 g/m$^2$) and further coating an aqueous gelatin solution on the upper layer at a gelatin coverage of 1 g/m$^2$ as a protective layer.

Also, Sample Nos. 56 to 63 were prepared in the same manner as described above except that the disposition order of the upper layer and the lower layer was the reverse of the above-described order.

After exposing each of the samples through a sensitometric optical wedge to tungsten light of 3200° K., each sample was developed with a developer having the composition shown below at 38° C. for 30 seconds, fixed, washed, and dried (using an automatic processor FG-660F, made by Fuji Photo Film Co. for the processing).

| Developer Composition: | |
|---|---|
| Hydroquinone | 35.0 g |
| N—Methyl-p-aminophenol ½ sulfate | 0.8 g |
| Sodium hydroxide | 9.0 g |
| Potassium tertiary phosphate | 74.0 g |
| Potassium sulfite | 90.0 g |
| Ethylenediaminetetraacetic acid di-sodium salt | 1.0 g |
| Potassium bromide | 3.0 g |
| 5-Methylbenzotriazole | 0.6 g |
| 3-Diethylamino-1-propanol | 15.0 g |
| Water to make | 1 liter |

The characteristic curve was obtained from each sample thus processed and also the sensitivity (the sensitivity of Sample No. 39 was defined as 100) and the $\gamma_L$ and the $\gamma_H$ were obtained from the exposure amount for producing a density of 1.5. Also, the line image was photographed using each sample described above and after processing as above, the line image exposure latitude and real Dmax were evaluated in the manner as described above.

The results thus obtained for the single emulsion layer samples are shown in Table 5 below and the results obtained for the double emulsion layer samples are shown in Table 6 below.

TABLE 5

| Sample No. | Emulsion No. | Sensitivity | $\gamma_L$ | $\gamma_H$ | Line Image Exposure Latitude | Real Dmax |
|---|---|---|---|---|---|---|
| 39 | A | 100 | 4.5 | 7.5 | 0.95 | 3.3 |
| 40 | B | 129 | 4.2 | 7.3 | 0.97 | 3.4 |
| 41 | C | 145 | 3.8 | 6.9 | 0.94 | 3.2 |
| 42 | E | 170 | 4.3 | 7.2 | 0.96 | 3.2 |
| 43 | F | 214 | 4.1 | 6.8 | 0.94 | 3.1 |

TABLE 5-continued

| Sample No. | Emulsion No. | Sensitivity | $\gamma_L$ | $\gamma_H$ | Line Image Exposure Latitude | Real Dmax |
|---|---|---|---|---|---|---|
| 44 | G | 263 | 3.7 | 6.5 | 0.98 | 3.2 |
| 45 | P | 79 | 14 | 18 | 0.65 | 5.2 |
| 46 | Q | 132 | 16 | 21 | 0.62 | 5.0 |
| 47 | R | 219 | 17 | 25 | 0.58 | 4.7 |

TABLE 6

| Sample No. | Emulsion No. Upper Layer | Emulsion No. Lower Layer | Sensitivity | $\gamma_L$ | $\gamma_H$ | Line Image Exposure Latitude | Real Dmax |
|---|---|---|---|---|---|---|---|
| 48 | A | Q | 107 | 8.4 | 18 | 0.86 | 4.6 |
| 49 | B | " | 138 | 6.7 | 17 | 0.93 | 4.4 |
| 50 | C | " | 158 | 5.2 | 12 | 0.90 | 4.1 |
| 51 | E | " | 186 | 4.5 | 8.5 | 0.88 | 3.4 |
| 52 | C | R | 162 | 12 | 20 | 0.65 | 4.2 |
| 53 | E | " | 182 | 8.7 | 17 | 0.80 | 4.6 |
| 54 | F | " | 229 | 7.5 | 15 | 0.89 | 4.5 |
| 55 | G | " | 275 | 5.2 | 11 | 0.93 | 4.2 |
| 56 | P | A | 85 | 8.2 | 15 | 0.82 | 4.9 |
| 57 | " | B | 98 | 7.5 | 14 | 0.86 | 4.7 |
| 58 | " | C | 107 | 6.8 | 12 | 0.91 | 4.3 |
| 59 | " | E | 123 | 5.0 | 8.8 | 0.88 | 3.7 |
| 60 | Q | C | 138 | 12 | 19 | 0.69 | 4.5 |
| 61 | " | E | 151 | 9.2 | 18 | 0.81 | 4.5 |
| 62 | " | F | 174 | 8.0 | 14 | 0.87 | 4.2 |
| 63 | " | G | 195 | 6.8 | 12 | 0.93 | 4.1 |

From the results shown in Table 5, it can be seen that Sample Now. 39 to 44 (comparison samples) with a single emulsion layer have good line image exposure latitude but have undesirably low real Dmax and also Sample Nos. 45 to 47 (comparison examples) have high real Dmax but have undesirably narrow line image exposure latitude.

It is preferred that the line image exposure latitude be at least 0.8 and real Dmax be at least 4.0 as described above and both of these factors must be satisfied. However, the comparison samples shown in Table 5 do not satisfy one of these factors.

The samples shown in Table 6 are all double emulsion layer samples. Sample Nos. 48 to 50, 53 to 58, and 61 to 63 are samples of this invention, and Sample Nos. 51 and 52 and 59 and 60 are comparison samples. From the results shown in Table 6, it can be seen that the samples of this invention have the $\gamma$ values in the ranges defined in this invention and have good line image exposure latitude and good real Dmax.

EXAMPLE 4

A silver chloroiodobromide emulsion (silver iodide 0.1 mol%, silver bromide 30 mol%) was prepared using a double jet method. In preparing the emulsion, a rhodium salt and an iridium salt were added to the aqueous halide solution so that the emulsion contained $1\times10^{-6}$ mol/mol-Ag of $(NH_4)_3RhCl_6$ as rhodium salt and $4\times10^{-7}$ mol/mol-Ag of $K_3IrCl_6$ as iridium salt and the aqueous halide solution was mixed with an aqueous silver nitrate solution for 60 minutes at 50° C. to form the silver halide grains. After washing the silver chloroiodobromide emulsion (mean grain size 0.30 μm, cubic, mono-dispersed emulsion) with water to remove salts, the emulsion was subjected to gold-sulfur sensitization. The emulsion was further spectrally sensitized by the addition of the above-described dimethinemerocyanine dye (I) and then by adding thereto 2-methyl-4-hydroxy-1,3,3a,7-tetraazaindene as a stabilizer, a dispersion of 1,4-dihydroxybenzene and polyethyl acrylate, and 1,3-vinylsulfonyl-2-propanol, Emulsion A' was prepared.

Furthermore, by adding 0.1 g/m$^2$ or 0.3 g/m$^2$ of Compound IV-7 to Emulsion A' as a quinone scavenger, Emulsion B' or C' was prepared, respectively. Also, by adding 0.1 or 0.3 g/m$^2$ of Compound IV-17 as a quinone scavenger to Emulsion A', Emulsion D' or E' was prepared, respectively. These emulsions were all for upper layer.

Then, a silver chloroiodobromide emulsion (silver iodide 0.1 mol%, silver bromide 30 mol%) having a mean grain size of 0.19 μm was prepared in the same manner as in the case of preparing Emulsion A' except that the rhodium salt $(NH_4)_3RhCl_6$ was added in an amount of $5\times10^{-6}$ mol/mol-Ag and the temperature and time for forming the silver halide grains were 40° C. and 30 minutes. After washing the emulsion with water as Emulsion A' to remove salts, the emulsion was subjected to gold-sulfur sensitization and then spectrally sensitized by the addition of dimethinemerocyanine dye (I). Then, by adding thereto 2-methyl-4-hydroxy-1,3,3a,7-tetraazaindene as a stabilizer, a dispersion of 1,4-dihydroxybenzene and polyethyl acrylate, 1,3-vinylsulfonyl-2-propanol, and $6\times10^{-4}$ mol/mol-Ag of Compound I-12 as a hydrazine compound, Emulsion F' was prepared.

Then, a cubic mono-dispersed silver halide emulsion having a mean grain size of 0.20 μm and a mean silver iodide content of 1 mol% was prepared by simultaneously adding an aqueous silver nitrate solution and an aqueous solution of potassium iodide and potassium bromide to an aqueous gelatin solution kept at 50° C. in the presence of $4\times10^{-7}$ mol/mol-Ag of potassium iridium(III) hexachloride and ammonia while maintaining the pAg at 7.8.

After sulfur-sensitizing the emulsion with sodium thiosulfate, the emulsion was further spectrally sensitized with the addition of a sensitizing dye, 5,5'-dichloro-3,3'-di(3-sulfopropyl)-9-ethyl-oxacarbocyanine sodium salt in an amount of $6\times10^{-4}$ mol per mol of silver. Then, by adding thereto 4-hydroxy-6-methyl-1,3,3a,7-tetraazaindene as a stabilizer, an alkylbenzenesulfonate as a surface active agent, 1,3-vinylsulfonyl-2-propanol as a hardening agent, $5\times10^{-3}$ mol/mol-Ag of Compound I-12 as a hydrazine compound, and a dispersion of polyethyl acrylate, Emulsion G' was prepared.

Emulsions F' and G' were for lower layer.

Then, a coating composition for (a) interlayer was prepared by adding sodium dodecylbenzenesulfonate as a anionic surface active agent and poly-potassium p-vinylbenzene sulfonate as a tackifier to an aqueous gelatin solution.

By adding 0.1 g/m$^2$ or 0.3 g/m$^2$ of Compound IV-7 as a quinone scavenger to Coating Composition (a), Coating Composition (b) or (c) for an interlayer was prepared, respectively.

Also, by adding 0.1 g/m$^2$ or 0.3 g/m$^2$ of Compound IV-17 as a quinone scavenger to Coating Composition (a), Coating Composition (d) or (e) for an interlayer was prepared, respectively.

The samples shown in Table 7 below were prepared by coating each of Emulsions F' and G' as the lower layer, each of Coating Compositions (a) to (e) as an interlayer, and each of Emulsions A' to E' as the upper layer at a silver coverage of 1.7 g/m$^2$ in each emulsion layer (the total silver coverage of the upper and lower layers was 3.4 g/m$^2$) and a gelatin coverage of 1.5 g/m$^2$ in the interlayer, and also forming a gelatin protective layer thereon at a gelatin coverage of 1.0 g/m$^2$. A polyethylene terephthalate film of 100 μm in thickness was used as the support.

Each of the samples was exposed through a sensitometric optical wedge to tungsten light of 3200° K. for 5 seconds, developed with a developer having the composition below for 30 seconds at 38° C., fixed, washed and dried (using an automatic processor FG-660F, made by Fuji Photo Film Co.).

| Developer Composition: | |
|---|---|
| Hydroquinone | 35.0 g |
| N—Methyl-p-aminophenol ½ sulfate | 0.8 g |
| Sodium hydroxide | 9.0 g |
| Potassium tertiary phosphate | 74.0 g |
| Potassium sulfite | 90.0 g |
| Ethylenediaminetetraacetic acid di-sodium salt | 1.0 g |
| Potassium bromide | 3.0 g |
| 5-Methylbenzotriazole | 0.6 g |
| 3-Diethylamino-1-propanol | 15.0 g |
| Water to make | 1 liter (pH = 11.6) |

The characteristic curve was obtained for each sample thus processed and the sensitivity (the sensitivity of Sample No. 64 was defined as 100) was calculated from the exposure amount for producing a density of 1.5 and $\gamma_L$ and the $\gamma H$ were calculated from the characteristic curve.

The line image was photographed using each sample and after processing the sample as above, the line image exposure latitude and real Dmax were evaluated in the manner described hereinbefore. The results thus obtained are shown in Table 7 below.

TABLE 7

| Sample No. | Lower Layer | Interlayer | Upper Layer | Sensitivity | $\gamma_L$ | $\gamma_H$ | Line Image Exposure Latitude | Real Dmax |
|---|---|---|---|---|---|---|---|---|
| 64 | F' | — | A' | 100 | 13 | 19 | 0.63 | 4.7 |
| 65 | G' | — | " | 123 | 14 | 20 | 0.61 | 4.9 |
| 66 | F' | (a) | " | 105 | 12 | 19 | 0.65 | 4.5 |
| 67 | G' | " | " | 120 | 13 | 19 | 0.63 | 4.8 |
| 68 | F' | (b) | " | 100 | 8.4 | 19 | 0.90 | 4.6 |
| 69 | " | (c) | " | 98 | 7.0 | 18 | 0.97 | 4.5 |
| 70 | " | (d) | " | 100 | 8.8 | 18 | 0.89 | 4.7 |
| 71 | " | (e) | " | 98 | 7.3 | 17 | 0.95 | 4.6 |
| 72 | G' | (b) | " | 105 | 8.6 | 19 | 0.89 | 4.9 |
| 73 | " | (c) | " | 102 | 7.3 | 18 | 0.97 | 4.8 |
| 74 | " | (d) | " | 102 | 8.9 | 19 | 0.88 | 4.9 |
| 75 | " | (e) | " | 100 | 7.5 | 17 | 0.95 | 4.7 |
| 76 | F' | (a) | B' | 100 | 8.4 | 18 | 0.86 | 4.5 |

TABLE 7-continued

| Sample No. | Lower Layer | Interlayer | Upper Layer | Sensitivity | $\gamma_L$ | $\gamma_H$ | Line Image Exposure Latitude | Real Dmax |
|---|---|---|---|---|---|---|---|---|
| 77 | " | " | C' | 98 | 7.0 | 18 | 0.92 | 4.3 |
| 78 | " | " | D' | 100 | 8.7 | 18 | 0.85 | 4.6 |
| 79 | " | " | E' | 98 | 7.4 | 17 | 0.91 | 4.5 |
| 80 | G' | (a) | B' | 102 | 8.7 | 19 | 0.84 | 4.8 |
| 81 | " | " | C' | 100 | 7.3 | 18 | 0.91 | 4.7 |
| 82 | " | " | D' | 100 | 9.0 | 19 | 0.82 | 4.8 |
| 83 | " | " | E' | 98 | 7.5 | 18 | 0.91 | 4.7 |
| 84 | F' | — | B' | 105 | 8.8 | 17 | 0.87 | 4.5 |
| 85 | " | — | C' | 102 | 7.3 | 16 | 0.92 | 4.3 |
| 86 | " | — | D' | 102 | 8.9 | 17 | 0.86 | 4.6 |
| 87 | " | — | E' | 100 | 7.7 | 15 | 0.93 | 4.4 |
| 88 | G' | — | B' | 105 | 8.8 | 17 | 0.84 | 4.7 |
| 89 | " | — | C' | 105 | 7.5 | 16 | 0.91 | 4.6 |
| 90 | " | — | D' | 102 | 9.2 | 17 | 0.83 | 4.7 |
| 91 | " | — | E' | 100 | 7.6 | 15 | 0.92 | 4.5 |

From the results shown in Table 7, it can be seen that Comparison Sample Nos. 64 to 67 without a quinone scavenger undesirably had narrow line image exposure latitude but Sample Nos. 68 to 91 of this invention had good line image exposure latitude.

Comparison Sample Nos. 64 to 67 have high $\gamma_L$, which causes a reduction in the line image exposure latitude. However, by using a quinone scavenger, the line image exposure latitude can be improved as seen by the above results.

If the $\gamma_L$ value is 7 or more, the line image quality is excellent and no problems arise. Also, there are no problem in sensitivity and real Dmax in the samples of this invention and the line image exposure latitude is improved in these samples.

When an interlayer is not present, the line image latitude is good in the case of a quinone scavenger present in the soft tone emulsion layer. Also, it can be seen from the above results that when an interlayer is employed and the interlayer contains a quinone scavenger, more preferred results are obtained with respect to the real Dmax.

EXAMPLE 5

By adding Compound V-6 or Compound V-8 as a quinone scavenger to the Coating Composition (a) for an interlayer as in Example 4 so that the coverage of the scavenger has 0.1 g/m$^2$ in each case, Coating Compositions (f) and (g) for an interlayer were prepared.

Also, by adding Compound VI-4 or VII-5 to Coating Composition (a) for an interlayer so that the coverage of the quinone scavenger was 0.1 g/m$^2$ in each case, Coating Compositions (h) and (i) for an interlayer were prepared.

In the same manner as described in Example 4, Sample Nos. 92 to 99 were prepared using Emulsion F' or G' as the lower layer, Coating Compositions (f) to (i) as an interlayer, and Emulsion A' as the upper layer; and also forming thereon a gelatin protective layer.

Each of the samples was exposed and developed as described in Example 4 and the sensitivity, the $\gamma_L$, $\gamma_H$, the line image exposure latitude, and the real Dmax of these samples thus processed were evaluated in the same manner as described above. The results thus obtained are shown in Table 8 below.

TABLE 8

| Sample No. | Lower Layer | Interlayer | Upper Layer | Sensitivity | $\gamma_L$ | $\gamma_H$ | Line Image Exposure Latitude | Real Dmax |
|---|---|---|---|---|---|---|---|---|
| 66 | F' | (a) | A' | 105 | 12 | 19 | 0.65 | 4.5 |
| 67 | G' | " | " | 120 | 13 | 19 | 0.63 | 4.8 |
| 92 | F' | (f) | " | 100 | 8.3 | 18 | 0.87 | 4.7 |
| 93 | " | (g) | " | 97 | 8.6 | 17 | 0.85 | 4.6 |
| 94 | " | (h) | " | 102 | 7.4 | 19 | 0.90 | 4.7 |
| 95 | " | (i) | " | 100 | 7.1 | 18 | 0.91 | 4.5 |
| 96 | G' | (f) | " | 108 | 8.5 | 18 | 0.85 | 4.6 |
| 97 | " | (g) | " | 110 | 8.4 | 17 | 0.83 | 4.6 |
| 98 | " | (h) | " | 107 | 7.6 | 18 | 0.89 | 4.7 |
| 99 | " | (i) | " | 115 | 7.5 | 19 | 0.90 | 4.5 |

From the results shown in Table 8 above, it can be seen that Sample Nos. 92 to 99 of this invention using the quinone scavengers have improved line image exposure latitude as compared with Comparison Sample Nos. 66 and 67 without a quinone scavenger.

While the invention has been described in detail and with reference to specific embodiments thereof, it will be apparent to one skilled in the art that various changes and modifications can be made therein without departing from the spirit and scope thereof.

What is claimed is:

1. An image forming process which comprises processing an image-wise exposed silver halide light-sensitive material having at least two silver halide emulsion layers on a support, one of said emulsion layers providing a contrasty gradation and the other of said emulsion layers providing a soft tone gradation, with a hydrazine contrast development system, a tetrazolium contrast development system or a lith development system, wherein the gamma ($\gamma$) value of the portion having a density (D) from 0.3 to 1.5 on the characteristic curve obtained is less than 10 and the gamma ($\gamma$) value of the portion having a density (D) from 1.5 to 3.0 is at least 10.

2. The image forming process of claim 1, wherein at least one of said silver halide emulsion layers contains a hydrazine derivative, and said processing is with a hydrazine contrast development system using a developer containing at least 0.15 mol/liter of sulfite ion and having a pH of 9.5 to 12.3.

3. The image forming process of claim 1, wherein at least one of said silver halide emulsion layers contains a tetrazolium compound, and said processing is with a tetrazolium contrast development system using a developer containing at least 0.15 mol/liter of sulfite ion and having a pH of 9.0 to 12.0.

4. The image forming process of claim 1, wherein at least one of said silver halide emulsion layer is a lith emulsion layer containing at least 60 mol% silver chloride and containing a polyalkylene oxide compound, and said processing is with a lith development system.

5. The image forming process of claim 2, wherein said silver halide material contains a silver halide emulsion layer substantially containing no hydrazine derivative or other hydrophilic colloid layer thereof but contains a quinone scavenger.

6. The image forming process of claim 1, wherein the $\gamma$ value of the portion having a density from 0.3 to 1.5 is from 2 to 9 and the $\gamma$ value of the portion having a density from 1.5 to 3.0 is at least 12.

7. The image forming process of claim 1, wherein the $\gamma$ value of the portion having a density from 0.3 to 1.5 is from 4 to 8 and the $\gamma$ value of the portion having a density from 1.5 to 3.0 is from 12 to 50.

8. The image forming process of claim 1, wherein the sensitivity ($S_H$) of the contrasty emulsion layer in relation to the sensitivity ($S_S$) of the soft tone gradation emulsion layer satisfies the following relationship $$0 \leqq |S_H - S_S| \leqq 0.6.$$

9. The image forming process of claim 2, wherein said hydrazine derivative is represented by the general formula (I)

$$R_1\text{—NHNH—}G_1\text{—}R_2 \qquad \text{(I)}$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and $G_1$ represents a carbonyl group, a sulfonyl group, a sulfinyl group, an N-substituted or unsubstituted iminomethylene group, or a mono-substituted phosphoryl group represented by

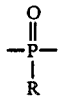

wherein R represents a substituted or unsubstituted alkoxy group, a substituted or unsubstituted alkyl group, or a substituted or unsubstituted phenyl group.

10. The image forming process of claim 3, wherein said tetrazolium compound is a compound selected from the group consisting of compounds represented by the formula (IIa), (IIb) or (IIc):

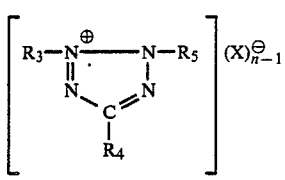

(IIa)

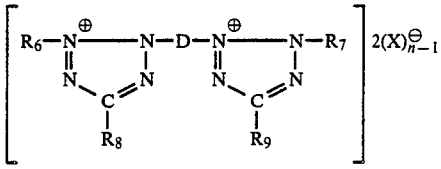

(IIb)

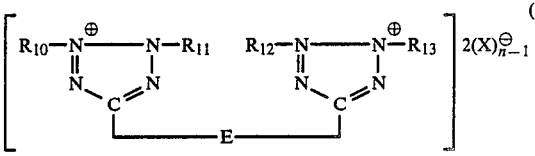

(IIc)

wherein $R_3$, $R_5$, $R_6$, $R_7$, $R_{10}$, $R_{11}$, $R_{12}$, and $R_{13}$ each represents an allyl group, a phenyl group, a naphthyl group or a heterocyclic group; $R_4$, $R_8$, and $R_9$ each represents an allyl group, a phenyl group, a naphthyl group, a heterocyclic group, an alkyl group, a hydroxy group, a carboxy group or a salt thereof, an alkoxycarbonyl group, an amino group, a mercapto group, a nitro group, a cyano group, or a hydroxy group; D represents a divalent aromatic group; E represents an alkylene group, an allylene group, or an aralkylene group; X represents an anion-forming atom or atomic group; and n represents 1 or 2.

11. The image forming process of claim 4, wherein said polyalkylene oxide compound is a condensation product of a polyalkylene oxide composed of at least 10 units of alkylene oxide having 2 to 4 carbon atoms and a compound having at least one active hydrogen, or a block copolymer of one or more polyalkylene oxides.

* * * * *